US009534397B2

(12) United States Patent
Palsson

(10) Patent No.: US 9,534,397 B2
(45) Date of Patent: Jan. 3, 2017

(54) FLOORING MATERIAL

(71) Applicant: PERGO (EUROPE) AB, Trelleborg (SE)

(72) Inventor: Jorgen Palsson, Landskrona (SE)

(73) Assignee: PERGO (EUROPE) AB, Trelleborg (SE)

( * ) Notice: Subject to any disclaimer, the term of this patent is extended or adjusted under 35 U.S.C. 154(b) by 0 days.

(21) Appl. No.: 14/076,879

(22) Filed: Nov. 11, 2013

(65) Prior Publication Data

US 2014/0137506 A1 May 22, 2014

Related U.S. Application Data

(60) Continuation of application No. 12/010,587, filed on Jan. 28, 2008, now Pat. No. 8,578,675, which is a (Continued)

(30) Foreign Application Priority Data

Mar. 31, 2000 (SE) ..... 0001149

(51) Int. Cl.
*E04F 15/02* (2006.01)
*E04F 15/04* (2006.01)

(52) U.S. Cl.
CPC ..... *E04F 15/02* (2013.01); *E04F 15/02038* (2013.01); *E04F 15/04* (2013.01); (Continued)

(58) Field of Classification Search
CPC .... E04F 15/02038; E04F 15/02; E04F 15/041; E04F 2201/0153; E04F 2201/026; E04F 2201/0138;E04F 2201/0115; E04F 2201/05; E04F 2201/0523; E04F 2201/023; E04F 2201/0517
(Continued)

(56) References Cited

U.S. PATENT DOCUMENTS 87,853 A 3/1869 Kappes
108,068 A 10/1870 Utley
(Continued)

FOREIGN PATENT DOCUMENTS

AT 002214 1/1975
AT 000 112 U2 2/1995
(Continued)

OTHER PUBLICATIONS

Knight's American Mechanical Dictionary, vol. III. 1876, definition of scarf.

(Continued)

*Primary Examiner* — Jessica Laux
(74) *Attorney, Agent, or Firm* — Jenkins, Wilson, Taylor & Hunt, P.A.

(57) ABSTRACT

A surface element designed to be assembled together with similar surface elements to form a unit of a plurality of joined surface elements; said surface elements comprising a core, a decorative upper surface and edges for joining, including a first and a second edges allowing joining by rotational movement, and a third and a fourth edge allowing joining by vertical movement, wherein two adjacent edges of the surface element at the same time, and concurrently with said rotational movement, is joined with a surface element adjacent to the first edge and a surface element adjacent to the third or fourth edge.

9 Claims, 3 Drawing Sheets

Related U.S. Application Data division of application No. 10/242,674, filed on Sep. 13, 2002, now Pat. No. 7,332,053, and a continuation-in-part of application No. 09/988,014, filed on Nov. 16, 2001, now abandoned, and a continuation-in-part of application No. 09/672,076, filed on Sep. 29, 2000, now Pat. No. 6,591,568.

(52) U.S. Cl.
CPC ..... *E04F 2201/0115* (2013.01); *E04F 2201/0138* (2013.01); *E04F 2201/0153* (2013.01); *E04F 2201/023* (2013.01); *E04F 2201/026* (2013.01); *E04F 2201/05* (2013.01); *E04F 2201/0517* (2013.01); *E04F 2201/0523* (2013.01)

(58) Field of Classification Search
USPC ..... 52/586.1, 586.2, 591.5, 592.2, 589.1,52/591.3, 591.4, 592.3
See application file for complete search history.

(56) References Cited

U.S. PATENT DOCUMENTS 208,036 A 9/1878 Robley
213,740 A 4/1879 Conner
274,354 A 3/1883 McCarthy et al.
308,313 A 11/1884 Gerike
338,653 A 5/1886 Whitmore
342,529 A 5/1886 McRae
502,289 A 8/1893 Feldman
662,458 A 11/1900 Nagel
713,577 A 11/1902 Wickham
714,987 A 12/1902 Wolfe
752,694 A 2/1904 Lund
753,791 A 3/1904 Fulghum
769,355 A 9/1904 Platow
832,003 A 9/1906 Torrence
847,272 A 3/1907 Ayers
877,639 A 1/1908 Galbraith
890,436 A 6/1908 Momberg
898,381 A 9/1908 Mattison
1,000,859 A 8/1911 Vaughan
1,002,102 A 8/1911 Weedon
1,016,383 A 2/1912 Wellman
1,078,776 A 11/1913 Dunton
1,097,986 A 5/1914 Moritz
1,124,226 A 1/1915 Houston
1,124,228 A 1/1915 Houston
1,137,197 A 4/1915 Ellis
1,140,958 A 5/1915 Cowan
1,201,285 A 10/1916 Gray
1,266,253 A 5/1918 Hakason
1,319,286 A 10/1919 Johnson et al.
1,357,713 A 11/1920 Lane
1,371,856 A 3/1921 Cade
1,407,679 A 2/1922 Ruchrauff
1,411,415 A 4/1922 Cooley
1,436,858 A 11/1922 Reinhart
1,454,250 A 5/1923 Parsons
1,468,288 A 9/1923 Fen
1,510,924 A 10/1924 Daniels et al.
1,540,128 A 6/1925 Houston
1,575,821 A 3/1926 Daniels
1,576,527 A 3/1926 McBride
1,576,821 A 3/1926 Daniels
1,602,256 A 10/1926 Sellin
1,602,267 A 10/1926 Karwisde
1,615,096 A 1/1927 Myers
1,622,103 A 3/1927 Fulton
1,622,104 A 3/1927 Fulton
1,637,634 A 8/1927 Carter
1,644,710 A 10/1927 Crooks
1,657,159 A 1/1928 Greenebaum
1,660,480 A 2/1928 Daniels
1,706,924 A 3/1929 Kane
1,714,738 A 5/1929 Smith
1,718,702 A 6/1929 Pfiester
1,723,306 A 8/1929 Sipe
1,734,826 A 11/1929 Pick
1,736,539 A 11/1929 Lachman
1,743,492 A 1/1930 Sipe
1,764,331 A 6/1930 Moratz
1,772,417 A 8/1930 Ellinwood
1,776,188 A 9/1930 Langbaum
1,823,039 A 9/1930 Gruner
1,778,069 A 10/1930 Fetz
1,787,027 A 12/1930 Wasleff
1,801,093 A 4/1931 Larkins
1,843,024 A 1/1932 Werner
1,854,396 A 4/1932 Davis
1,859,667 A 5/1932 Gruner
1,864,774 A 6/1932 Storm
1,477,813 A 12/1932 Daniels et al.
1,898,364 A 2/1933 Gynn
1,906,411 A 5/1933 Potvin
1,913,342 A 6/1933 Schaffert
1,929,871 A 10/1933 Jones
1,940,377 A 12/1933 Storm
1,946,646 A 2/1934 Storm
1,953,306 A 4/1934 Moratz
1,966,020 A 7/1934 Rowley
1,978,075 A 10/1934 Butterworth
1,986,739 A 1/1935 Mitte
1,988,201 A 1/1935 Hall
1,991,701 A 2/1935 Roman
2,004,193 A 6/1935 Cherry
2,015,813 A 10/1935 Nielsen
2,027,292 A 1/1936 Rockwell
2,044,216 A 6/1936 Klages
2,045,067 A 6/1936 Bruce
2,049,571 A 8/1936 Schuck
2,088,405 A 7/1937 Cahn
2,100,238 A 11/1937 Burgess
RE20,816 E 8/1938 Haase
2,126,956 A 8/1938 Gilbert
2,138,085 A 11/1938 Birtles
2,141,708 A 12/1938 Elmendorf
2,142,305 A 1/1939 Davis
2,194,086 A 3/1940 Horn
2,199,938 A 5/1940 Kloote
2,222,137 A 11/1940 Bruce
2,226,540 A 12/1940 Boettcher
2,238,169 A 4/1941 Heyn et al.
2,245,497 A 6/1941 Potchen
2,253,943 A 8/1941 Rice
2,261,897 A 11/1941 Adams
2,263,930 A 11/1941 Pasquier
2,266,464 A 12/1941 Kraft
2,276,071 A 3/1942 Scull
2,280,071 A 4/1942 Hamilton
2,282,559 A 5/1942 Byers
2,324,628 A 7/1943 Kahr
2,360,933 A 10/1944 Bunker
2,363,429 A 11/1944 Lowry
2,381,469 A 8/1945 Sweet
2,398,632 A 4/1946 Frost et al.
2,405,602 A 8/1946 Nugent
2,430,200 A 11/1947 Wilson
2,441,364 A 5/1948 Maynard
2,487,571 A 11/1949 Maxwell
2,491,498 A 12/1949 Kahr
2,534,501 A 12/1950 Coleman
2,644,552 A 7/1953 MacDonanld
2,717,420 A 9/1955 Georges
2,729,584 A 1/1956 Foster
2,740,167 A 4/1956 Rowley
2,780,253 A 2/1957 Joa
2,805,852 A 9/1957 Ewert
2,808,624 A 10/1957 Sullivan
2,823,433 A 2/1958 Kendall
2,839,790 A 6/1958 Collings
2,857,302 A 10/1958 Burton et al.

(56) References Cited

U.S. PATENT DOCUMENTS 2,863,185 A 12/1958 Reidi
2,865,058 A 12/1958 Andersson et al.
2,875,117 A 2/1959 Potchen et al.
2,878,530 A 3/1959 Hilding
2,894,292 A 7/1959 Gramelspacher
2,914,815 A 12/1959 Alexander
2,926,401 A 3/1960 Place
2,947,040 A 8/1960 Schultz
2,831,223 A 9/1960 DeShazor
2,952,341 A 9/1960 Weiler
2,974,692 A 3/1961 Bolenbach
2,996,751 A 8/1961 Roby
3,039,575 A 6/1962 Graham
3,040,388 A 6/1962 Conn
3,045,294 A 7/1962 Livezey, Jr.
3,090,082 A 5/1963 Bauman
3,100,556 A 8/1963 Ridder
3,125,138 A 3/1964 Bolenbach
3,128,851 A 4/1964 Deridder et al.
3,141,392 A 7/1964 Schneider
3,145,503 A 8/1964 Brechin
3,148,482 A 9/1964 Neale
3,162,906 A 12/1964 Dudley
3,172,508 A 3/1965 Doering et al.
3,174,411 A 3/1965 Oestrich et al.
3,175,476 A 3/1965 Franks
3,182,769 A 5/1965 De Ridder
3,192,574 A 7/1965 Jaffe et al.
3,199,258 A 8/1965 Jentoft et al.
3,200,553 A 8/1965 Frashour et al.
3,203,149 A 8/1965 Soddy
3,204,380 A 9/1965 Wilson
3,205,633 A 9/1965 Nusbaum
3,253,377 A 5/1966 Schakel
3,257,225 A 6/1966 Marotta
3,267,630 A 8/1966 Omholt
3,282,010 A 11/1966 King, Jr.
3,286,425 A 11/1966 Brown
3,296,056 A 1/1967 Bechtold
3,301,147 A 1/1967 Clayton et al.
3,310,919 A 3/1967 Bue
3,313,072 A 4/1967 Cue
3,331,171 A 7/1967 Hallock
3,331,176 A 7/1967 Washam
3,332,192 A 7/1967 Kessler et al.
3,339,329 A 9/1967 Berg
3,347,048 A 10/1967 Brown et al.
3,362,127 A 1/1968 McGowan
3,363,381 A 1/1968 Forrest
3,363,382 A 1/1968 Forrest
3,363,383 A 1/1968 La Barge
3,373,071 A 3/1968 Fuerst
3,377,931 A 4/1968 Hilton
3,385,182 A 5/1968 Harvey
3,387,422 A 6/1968 Wanzer
3,397,496 A 8/1968 Sohns
3,444,660 A 5/1969 Feichter
3,449,879 A 6/1969 Bloom
3,460,304 A 8/1969 Braeuninger et al.
3,473,278 A 10/1969 Gossen
3,474,584 A 10/1969 Lynch
3,479,784 A 11/1969 Massagli
3,481,810 A 12/1969 Waite
3,488,828 A 1/1970 Gallagher
3,496,119 A 2/1970 Fitzgerald
3,508,369 A 4/1970 Tennison
3,512,324 A 5/1970 Reed
3,526,420 A 9/1970 Brancaleone
3,535,844 A 10/1970 Glaros
3,538,665 A 11/1970 Gohner
3,538,819 A 11/1970 Gould et al.
3,548,559 A 12/1970 Levine
3,553,919 A 1/1971 Omholt
3,555,761 A 1/1971 Rosebrough
3,555,762 A 1/1971 Costanzo, Jr.
3,570,205 A 3/1971 Payne
3,572,224 A 3/1971 Perry
3,579,941 A 5/1971 Tibbals
3,605,368 A 9/1971 Lalouche
3,619,964 A 11/1971 Passaro et al.
3,627,362 A 12/1971 Brenneman
3,640,191 A 2/1972 Hendrich
3,657,852 A 4/1972 Worthington et al.
3,665,666 A 5/1972 Delcroix
3,667,153 A 6/1972 Christensen
3,671,369 A 6/1972 Kvalheim et al.
3,673,751 A 7/1972 Boassy et al.
3,676,971 A 7/1972 Dombroski
3,679,531 A 7/1972 Wienand et al.
3,687,773 A 8/1972 Wangborg
3,694,983 A 10/1972 Couquet
3,696,575 A 10/1972 Armstrong
3,707,061 A 12/1972 Collette et al.
3,714,747 A 2/1973 Curran
3,720,027 A 3/1973 Christensen
3,731,445 A 5/1973 Hoffmann et al.
3,740,914 A 6/1973 Arnaiz Diez
3,742,672 A 7/1973 Schaeufele
3,745,726 A 7/1973 Thom
3,758,650 A 9/1973 Hurst
3,759,007 A 9/1973 Thiele
3,760,544 A 9/1973 Hawes et al.
3,760,548 A 9/1973 Sauer et al.
3,761,338 A 9/1973 Ungar et al.
3,768,846 A 10/1973 Hensley et al.
3,778,958 A 12/1973 Fowler
3,780,469 A 12/1973 Hancovsky
3,786,608 A 1/1974 Boettcher
3,798,111 A 3/1974 Lane et al.
3,807,113 A 4/1974 Turner
3,808,030 A 4/1974 Bell
3,810,707 A 5/1974 Tungseth et al.
3,849,111 A 11/1974 Kihlstedt
3,849,240 A 11/1974 Mikulak
3,859,000 A 1/1975 Webster
3,883,258 A 5/1975 Hewson
3,884,008 A 5/1975 Miller
3,884,328 A 5/1975 Williams
3,902,291 A 9/1975 Zucht
3,902,293 A 9/1975 Witt et al.
3,908,053 A 9/1975 Hettich
3,908,062 A 9/1975 Roberts
3,921,312 A 11/1975 Fuller
3,924,496 A 12/1975 DerMarderosian et al.
3,936,551 A 2/1976 Elmendorf et al.
3,936,758 A 2/1976 Kostelnicek et al.
3,953,661 A 4/1976 Gulley
3,987,599 A 10/1976 Hines
3,988,187 A 10/1976 Witt et al.
4,021,087 A 5/1977 Ferguson
4,037,377 A 7/1977 Howell et al.
4,059,933 A 11/1977 Funk et al.
4,060,437 A 11/1977 Strout
4,065,902 A 1/1978 Lindal
4,067,155 A 1/1978 Ruff et al.
4,074,496 A 2/1978 Fischer
4,090,338 A 5/1978 Bourgade
4,094,090 A 6/1978 Walmer
4,095,913 A 6/1978 Pettersson et al.
4,099,358 A 7/1978 Compaan
4,100,710 A 7/1978 Kowallik
4,143,498 A 3/1979 Martin et al.
4,144,689 A 3/1979 Bains
4,150,517 A 4/1979 Warner
4,156,048 A 5/1979 Davis
4,158,335 A 6/1979 Belcastro
4,164,832 A 8/1979 Van Zandt
4,165,305 A 8/1979 Sundie et al.
4,167,599 A 9/1979 Nissinen
4,169,688 A 10/1979 Toshio
4,182,072 A 1/1980 Much
4,186,539 A 2/1980 Harmon et al.
4,196,554 A 4/1980 Anderson et al.
4,198,455 A 4/1980 Spiro et al.

(56) References Cited

U.S. PATENT DOCUMENTS 4,226,064 A 10/1980 Kraayenhof
4,242,390 A 12/1980 Nemeth
4,247,390 A 1/1981 Knoll
4,292,774 A 10/1981 Mairle
4,299,070 A 11/1981 Oltmanns et al.
4,304,083 A 12/1981 Anderson
4,316,351 A 2/1982 Ting
4,372,899 A 2/1983 Wiemann et al.
4,376,593 A 3/1983 Schaefer
4,390,580 A 6/1983 Donovan et al.
4,416,097 A 11/1983 Weir
4,426,820 A * 1/1984 Terbrack et al. ..... 52/590.1
4,435,935 A 3/1984 Larrea
4,449,346 A 5/1984 Tremblay
4,455,803 A 6/1984 Kornberger
4,461,131 A 7/1984 Pressell
4,471,012 A 9/1984 Maxwell
4,489,115 A 12/1984 Layman et al.
4,501,102 A 2/1985 Knowles
4,503,115 A 3/1985 Hemels et al.
4,504,347 A 3/1985 Munk et al.
4,505,887 A 3/1985 Miyata et al.
4,512,131 A 4/1985 Laramore
4,517,147 A 5/1985 Taylor et al.
4,520,062 A 5/1985 Ungar et al.
4,538,392 A 9/1985 Hamar et al.
4,561,233 A 12/1985 Harter et al.
4,571,910 A 2/1986 Cosentino
4,594,347 A 6/1986 Ishikawa et al.
4,599,124 A 7/1986 Kelly et al.
4,599,841 A 7/1986 Haid
4,599,842 A 7/1986 Counihan
4,612,745 A 9/1986 Hovde
4,621,471 A 11/1986 Kuhr et al.
4,640,437 A 2/1987 Weingartner
4,641,469 A 2/1987 Wood
4,643,237 A 2/1987 Rosa
4,646,494 A 3/1987 Saarinen et al.
4,653,138 A 3/1987 Carder
4,653,242 A 3/1987 Ezard
4,672,728 A 6/1987 Nimberger
4,683,631 A 8/1987 Dobbertin
4,703,597 A 11/1987 Eggemar
4,715,162 A 12/1987 Brightwell
4,724,187 A 2/1988 Ungar et al.
4,733,510 A 3/1988 Werner
4,736,563 A 4/1988 Bilhorn
4,738,071 A 4/1988 Ezard
4,741,136 A 5/1988 Thompson
4,747,197 A 5/1988 Charron
4,754,658 A 7/1988 Kaempen
4,757,657 A 7/1988 Mitchell
4,757,658 A 7/1988 Kaempen
4,766,443 A 8/1988 Winegard et al.
4,769,963 A 9/1988 Meyerson
4,796,402 A 1/1989 Pajala
4,806,435 A 2/1989 Athey
4,819,532 A 4/1989 Benuzzi et al.
4,819,932 A 4/1989 Trotter, Jr.
4,819,935 A 4/1989 Trotter, Jr. et al.
4,831,806 A 5/1989 Niese et al.
4,844,972 A 7/1989 Tedeschi et al.
4,845,907 A 7/1989 Meek
4,888,933 A 12/1989 Guomundsson et al.
4,893,449 A 1/1990 Kemper
4,894,272 A 1/1990 Aisley
4,905,442 A 3/1990 Daniels
4,906,484 A 3/1990 Lambuth et al.
4,910,280 A 3/1990 Robbins, III
4,917,532 A 4/1990 Haberhauer et al.
4,920,626 A 5/1990 Nimberger
4,940,503 A 7/1990 Lindgren et al.
4,952,775 A 8/1990 Yokoyama et al.
4,953,335 A 9/1990 Kawaguchi et al.
4,988,131 A 1/1991 Wilson et al.
4,998,395 A 3/1991 Bezner
4,998,396 A 3/1991 Palmersten
5,003,016 A 3/1991 Boeder
5,016,413 A 5/1991 Counihan
5,029,425 A 7/1991 Bogataj
5,034,272 A 7/1991 Lindgren et al.
5,050,362 A 9/1991 Tal et al.
5,052,158 A 10/1991 D'Luzansky
5,058,333 A 10/1991 Schwartz
5,070,662 A 12/1991 Niese
5,074,089 A 12/1991 Kemmer et al.
5,086,599 A 2/1992 Meyerson
5,092,095 A 3/1992 Zadok
5,102,253 A 4/1992 Conti
5,109,898 A 5/1992 Schacht
5,113,632 A 5/1992 Hanson
5,117,603 A 6/1992 Weintraub
5,138,812 A 8/1992 Palmersten
5,148,850 A 9/1992 Urbanick
5,155,952 A 10/1992 Herwegh et al.
5,157,890 A 10/1992 Jines
5,165,816 A 11/1992 Parasin
5,179,811 A 1/1993 Walker et al.
5,179,812 A 1/1993 Hill
5,182,892 A 2/1993 Chase
5,215,802 A 6/1993 Kaars Sijpesteijn
5,216,861 A 6/1993 Meyerson
5,244,303 A 9/1993 Hair
5,247,773 A 9/1993 Weir
5,253,464 A 10/1993 Nilsen
5,259,162 A 11/1993 Nicholas
5,266,384 A 11/1993 O'Dell et al.
5,271,564 A 12/1993 Smith
5,274,979 A 1/1994 Tsai
5,283,102 A 2/1994 Sweet et al.
5,292,155 A 3/1994 Bell et al.
5,295,341 A 3/1994 Kajiwara
5,313,751 A 5/1994 Wittler
5,325,649 A 7/1994 Kajiwara
5,343,665 A 9/1994 Palmersten
5,344,700 A 9/1994 McGath et al.
5,348,778 A 9/1994 Knipp et al.
5,349,796 A 9/1994 Meyerson
5,359,817 A 11/1994 Fulton
5,365,713 A 11/1994 Nicholas et al.
5,390,457 A 2/1995 Sjolander
5,413,840 A 5/1995 Mizuno
5,424,118 A 6/1995 McLaughlin
5,425,302 A 6/1995 Levrai et al.
5,433,048 A 7/1995 Strasser
5,433,806 A 7/1995 Pasquali et al.
5,437,934 A 8/1995 Witt et al.
5,474,831 A 12/1995 Nystrom
5,475,960 A 12/1995 Lindal
5,497,589 A 3/1996 Porter
5,502,939 A 4/1996 Zadok et al.
5,526,857 A 6/1996 Forman
5,527,128 A 6/1996 Rope et al.
5,540,025 A 7/1996 Takehara et al.
D373,203 S 8/1996 Kornfalt
5,555,980 A 9/1996 Johnston et al.
5,566,519 A 10/1996 Almaraz-Miera
5,567,497 A 10/1996 Zegler et al.
5,570,554 A 11/1996 Searer
5,581,967 A 12/1996 Glatz
5,597,024 A 1/1997 Bolyard et al.
5,618,602 A 4/1997 Nelson
5,618,612 A 4/1997 Gstrein
5,623,799 A 4/1997 Kowalski
5,630,304 A 5/1997 Austin
5,647,181 A 7/1997 Hunts
5,657,598 A 8/1997 Wilbs et al.
5,671,575 A 9/1997 Wu
5,685,117 A 11/1997 Nicholson
5,688,569 A 11/1997 Gilmore et al.
5,692,354 A 12/1997 Searer
5,695,875 A 12/1997 Larsson et al.
5,706,621 A 1/1998 Pervan
5,706,623 A 1/1998 Brown

(56) References Cited

U.S. PATENT DOCUMENTS 5,719,239 A 2/1998 Mirous et al.
5,735,092 A 4/1998 Clayton et al.
5,736,227 A 4/1998 Sweet et al.
5,755,068 A 5/1998 Ormiston
5,765,808 A 6/1998 Butschbacher et al.
5,768,850 A 6/1998 Chen
5,791,114 A 8/1998 Mandel
5,797,237 A 8/1998 Finkell, Jr.
5,823,240 A 10/1998 Bolyard et al.
5,827,592 A 10/1998 Van Gulik et al.
5,860,267 A 1/1999 Pervan
D406,360 S 3/1999 Finkell, Jr.
5,888,017 A 3/1999 Corrie
5,894,701 A 4/1999 Delorme
5,904,019 A 5/1999 Kooij et al.
5,907,934 A 6/1999 Austin
5,930,947 A 8/1999 Eckhoff
5,931,447 A 8/1999 Butschbacher et al.
5,935,668 A 8/1999 Smith
5,937,612 A 8/1999 Winer et al.
5,941,047 A 8/1999 Johansson
5,943,239 A 8/1999 Shamblin et al.
5,945,181 A 8/1999 Fisher
5,950,389 A 9/1999 Porter
5,968,625 A 10/1999 Hudson
5,971,655 A 10/1999 Shirakawa
5,987,839 A 11/1999 Hamar et al.
5,987,845 A 11/1999 Laronde
5,996,301 A 12/1999 Conterno
6,006,486 A * 12/1999 Moriau et al. ..... 52/589.1
6,012,263 A 1/2000 Church et al.
6,021,615 A 2/2000 Brown
6,021,646 A 2/2000 Burley
6,023,907 A 2/2000 Pervan
6,029,416 A 2/2000 Andersson
6,079,182 A 6/2000 Ellenberger
6,094,882 A 8/2000 Pervan
6,098,365 A 8/2000 Martin et al.
6,101,778 A 8/2000 Martensson
6,106,654 A 8/2000 Velin et al.
6,119,423 A 9/2000 Costantino
6,122,879 A 9/2000 Montes
6,134,854 A 10/2000 Stanchfield
6,141,920 A 11/2000 Kemper
6,143,119 A 11/2000 Seidner
6,148,884 A 11/2000 Bolyard et al.
6,158,915 A 12/2000 Kise
6,164,031 A 12/2000 Counihan
6,182,410 B1 2/2001 Pervan
6,182,413 B1 2/2001 Magnusson
6,189,283 B1 2/2001 Bentley
6,205,639 B1 3/2001 Pervan
6,209,278 B1 4/2001 Tychsen
6,216,403 B1 4/2001 Belbeoc'h
6,216,409 B1 4/2001 Roy et al.
6,219,982 B1 4/2001 Eyring
6,230,385 B1 5/2001 Nelson
6,233,899 B1 5/2001 Mellert et al.
6,247,285 B1 6/2001 Moebus
6,253,514 B1 7/2001 Jobe et al.
6,271,156 B1 8/2001 Gleason et al.
6,314,701 B1 11/2001 Meyerson
6,321,499 B1 11/2001 Chuang
6,324,796 B1 12/2001 Heath
6,324,803 B1 12/2001 Pervan
6,324,809 B1 12/2001 Nelson
6,332,733 B1 12/2001 Hamberger et al.
6,345,480 B1 2/2002 Kemper
6,345,481 B1 2/2002 Nelson
6,346,861 B2 2/2002 Kim et al.
6,363,677 B1 4/2002 Chen et al.
6,363,678 B1 4/2002 Shuler
6,365,258 B1 4/2002 Alm
6,365,936 B1 4/2002 Alm
6,385,936 B1 5/2002 Schneider
6,397,547 B1 6/2002 Martensson
6,404,240 B1 6/2002 Hakkal et al.
6,418,683 B1 7/2002 Martensson et al.
6,421,970 B1 7/2002 Martensson et al.
6,423,257 B1 7/2002 Stobart
6,437,616 B1 8/2002 Antone et al.
6,438,919 B1 8/2002 Knauseder
6,446,405 B1 9/2002 Pervan
6,446,413 B1 9/2002 Gruber
6,449,918 B1 9/2002 Nelson
6,490,836 B1 12/2002 Moriau et al.
6,497,079 B1 12/2002 Pletzer et al.
6,505,452 B1 1/2003 Hannig et al.
6,510,665 B2 1/2003 Pervan
6,516,579 B1 2/2003 Pervan
6,517,935 B1 2/2003 Komfalt et al.
6,521,314 B2 2/2003 Tychsen
6,526,719 B2 3/2003 Pletzer et al.
6,532,709 B2 3/2003 Pervan
6,536,178 B1 3/2003 Palsson
6,546,691 B2 4/2003 Leopolder
6,550,205 B2 4/2003 Neuhofer
6,551,007 B2 4/2003 Lichtenberg et al.
6,588,165 B1 7/2003 Wright
6,588,166 B2 7/2003 Martensson et al.
6,591,568 B1 7/2003 Palsson
6,601,359 B2 8/2003 Olofsson
6,606,834 B2 8/2003 Martensson et al.
6,617,009 B1 9/2003 Chen et al.
6,647,689 B2 11/2003 Pletzer et al.
6,647,690 B1 11/2003 Martensson
6,670,019 B2 12/2003 Andersson
6,672,030 B2 1/2004 Schulte
6,681,820 B2 1/2004 Olofsson
6,682,254 B1 1/2004 Olofsson
6,685,391 B1 2/2004 Gideon
6,711,869 B2 3/2004 Tychsem
6,729,091 B1 5/2004 Martensson
6,745,534 B2 6/2004 Kornfalt
6,763,643 B1 7/2004 Martensson
6,769,217 B2 8/2004 Nelson
6,769,219 B2 8/2004 Schwitte et al.
6,769,835 B2 8/2004 Stridsman
6,786,016 B1 9/2004 Wood
6,802,166 B1 10/2004 Gerhard
6,804,926 B1 10/2004 Eisermann
6,805,951 B2 10/2004 Komfalt et al.
6,851,237 B2 2/2005 Niese et al.
6,851,241 B2 2/2005 Pervan
6,854,235 B2 2/2005 Martensson
6,860,074 B2 3/2005 Stanchfield
6,862,857 B2 3/2005 Tychsen
6,865,855 B2 3/2005 Knauseder
6,880,305 B2 4/2005 Pervan et al.
6,880,307 B2 4/2005 Schwitte et al.
6,898,913 B2 5/2005 Pervan
6,918,220 B2 7/2005 Pervan
6,920,732 B2 7/2005 Martensson
6,922,964 B2 8/2005 Pervan
6,931,798 B1 8/2005 Pocai
6,966,161 B2 11/2005 Palsson et al.
RE38,950 E 1/2006 Maiers et al.
7,003,924 B2 2/2006 Kettler et al.
7,015,727 B2 3/2006 Balasubramanian
7,021,019 B2 4/2006 Knauseder
7,051,486 B2 5/2006 Pervan
7,086,205 B2 8/2006 Pervan
7,121,058 B2 10/2006 Palsson et al.
7,121,059 B2 * 10/2006 Pervan ..... 52/592.2
7,131,242 B2 11/2006 Martensson
7,146,772 B2 12/2006 Ralf
7,152,507 B2 12/2006 Solari
7,188,456 B2 3/2007 Knauseder
7,210,272 B2 5/2007 Friday
7,251,916 B2 8/2007 Konzelmann et al.
7,332,053 B2 2/2008 Palsson et al.
7,337,588 B1 3/2008 Moebus
7,347,328 B2 3/2008 Hartwall
7,377,081 B2 5/2008 Ruhdorfer

(56) References Cited

U.S. PATENT DOCUMENTS 7,398,628 B2 7/2008 Van Horne
7,441,385 B2 10/2008 Palsson et al.
7,444,791 B1 * 11/2008 Pervan ..... 52/590.2
7,451,578 B2 11/2008 Hannig
7,484,337 B2 2/2009 Hecht
7,497,058 B2 3/2009 Martensson
7,552,568 B2 6/2009 Palsson et al.
7,603,826 B1 10/2009 Moebus
7,614,197 B2 11/2009 Nelson
7,617,651 B2 11/2009 Grafenauer
7,634,884 B2 12/2009 Pervan et al.
7,665,267 B2 2/2010 Moriau et al.
7,726,088 B2 6/2010 Muehleback
7,820,287 B2 10/2010 Kornfalt et al.
7,841,144 B2 11/2010 Pervan
7,856,784 B2 12/2010 Martensson
7,856,785 B2 12/2010 Pervan
7,856,789 B2 12/2010 Eisermann
7,877,956 B2 2/2011 Martensson
7,896,571 B1 3/2011 Hannig et al.
7,980,039 B2 7/2011 Groeke et al.
7,980,043 B2 7/2011 Moebus
8,006,458 B1 8/2011 Olofsson et al.
8,028,486 B2 10/2011 Pervan et al.
8,037,657 B2 10/2011 Sjoberg et al.
8,038,363 B2 * 10/2011 Hannig et al. ..... 403/339
8,117,795 B2 2/2012 Knauseder
8,146,318 B2 4/2012 Palsson
8,234,834 B2 8/2012 Martensson et al.
8,276,342 B2 10/2012 Martensson
8,402,709 B2 3/2013 Martensson
8,429,869 B2 4/2013 Pervan
8,516,767 B2 8/2013 Engstrom
8,544,233 B2 10/2013 Palsson
8,578,675 B2 * 11/2013 Palsson et al. ..... 52/592.2
8,615,952 B2 12/2013 Engstrom
8,631,623 B2 1/2014 Engstrom
8,661,762 B2 3/2014 Martensson et al.
8,720,148 B2 5/2014 Engstrom
8,789,334 B2 7/2014 Moriau et al.
8,875,465 B2 11/2014 Mårtensson
8,978,334 B2 3/2015 Engstrom
9,032,685 B2 5/2015 Martensson et al.
9,115,500 B2 8/2015 Engstrom
9,140,009 B2 9/2015 Engstrom
9,255,414 B2 2/2016 Palsson et al.
9,260,869 B2 2/2016 Palsson et al.
9,316,006 B2 4/2016 Palsson et al.
9,322,162 B2 4/2016 Olofsson et al.
2001/0024707 A1 9/2001 Andersson et al.
2001/0029720 A1 10/2001 Pervan
2002/0007608 A1 1/2002 Pervan
2002/0046526 A1 4/2002 Knauseder
2002/0046528 A1 4/2002 Pervan et al.
2002/0095895 A1 7/2002 Daly et al.
2002/0100242 A1 8/2002 Olofsson
2002/0112429 A1 8/2002 Niese et al.
2002/0112433 A1 8/2002 Pervan
2002/0127374 A1 9/2002 Spratling
2002/0148551 A1 10/2002 Knauseder
2002/0178573 A1 12/2002 Pervan
2002/0178674 A1 12/2002 Pervan
2002/0178681 A1 12/2002 Zancai et al.
2002/0178682 A1 12/2002 Pervan
2002/0189183 A1 12/2002 Ricciardelli
2002/0189747 A1 12/2002 Steinwender
2003/0009971 A1 1/2003 Palmberg
2003/0009972 A1 1/2003 Pervan et al.
2003/0024199 A1 2/2003 Pervan et al.
2003/0024200 A1 2/2003 Moriau et al.
2003/0033784 A1 2/2003 Pervan
2003/0084634 A1 5/2003 Stanchfield
2003/0084636 A1 5/2003 Pervan
2003/0094230 A1 5/2003 Sjoberg
2003/0112913 A1 6/2003 Balasubramanian
2003/0118812 A1 6/2003 Kornfalt
2003/0141004 A1 7/2003 Palmblad
2003/0145540 A1 8/2003 Brunedal
2003/0154678 A1 8/2003 Stanchfield
2003/0159389 A1 8/2003 Kornfalt
2003/0224147 A1 12/2003 Maine et al.
2004/0016197 A1 1/2004 Ruhdorfer
2004/0031225 A1 2/2004 Fowler
2004/0031226 A1 2/2004 Miller
2004/0031227 A1 2/2004 Knauseder
2004/0035077 A1 2/2004 Martensson et al.
2004/0040235 A1 3/2004 Kurtz
2004/0041225 A1 3/2004 Nemoto
2004/0139678 A1 7/2004 Pervan
2004/0182036 A1 9/2004 Sjoberg et al.
2004/0191461 A1 9/2004 Riccobene
2004/0211143 A1 10/2004 Hanning
2004/0211144 A1 10/2004 Stanchfield
2004/0250492 A1 12/2004 Becker
2005/0034405 A1 2/2005 Pervan
2005/0144881 A1 7/2005 Tate
2005/0166526 A1 8/2005 Stanchfield
2005/0210810 A1 9/2005 Pervan
2005/0252130 A1 11/2005 Martensson
2006/0101769 A1 5/2006 Pervan
2006/0236642 A1 10/2006 Pervan
2006/0248836 A1 11/2006 Martensson
2007/0006543 A1 1/2007 Engstrom
2007/0028547 A1 2/2007 Grafenauer et al.
2007/0240376 A1 10/2007 Engstrom
2008/0000286 A1 1/2008 Pervan
2008/0134613 A1 6/2008 Pervan
2008/0216434 A1 9/2008 Pervan
2008/0236088 A1 10/2008 Hannig
2008/0271403 A1 11/2008 Palsson
2009/0019806 A1 1/2009 Muehlebach
2009/0019808 A1 1/2009 Palsson et al.
2009/0064624 A1 3/2009 Sokol
2009/0100782 A1 4/2009 Groeke et al.
2009/0193748 A1 8/2009 Boo et al.
2009/0199500 A1 8/2009 LeBlang
2009/0217615 A1 9/2009 Engstrom
2009/0249733 A1 10/2009 Moebus
2010/0031599 A1 2/2010 Kennedy et al.
2010/0043333 A1 2/2010 Hannig
2010/0058700 A1 3/2010 LeBlang
2010/0236707 A1 9/2010 Studer et al.
2011/0078977 A1 4/2011 Martensson et al.
2011/0167751 A1 7/2011 Engstrom
2011/0173914 A1 7/2011 Engstrom
2011/0225922 A1 9/2011 Pervan et al.
2011/0271631 A1 11/2011 Engstrom
2011/0271632 A1 11/2011 Cappelle et al.
2011/0293361 A1 12/2011 Olofsson
2012/0042595 A1 2/2012 De Boe
2012/0055112 A1 3/2012 Engstrom
2012/0216472 A1 8/2012 Martensson et al.
2012/0233948 A1 9/2012 Palsson
2012/0247053 A1 10/2012 Martensson
2012/0291396 A1 11/2012 Martensson
2012/0304590 A1 12/2012 Engstrom
2013/0042555 A1 2/2013 Martensson
2013/0067840 A1 3/2013 Martensson
2013/0241103 A1 9/2013 Engstrom
2013/0291467 A1 11/2013 Palsson et al.
2014/0033630 A1 2/2014 Engstrom
2014/0157700 A1 6/2014 Martensson
2014/0157711 A1 6/2014 Palsson et al.
2014/0157721 A1 6/2014 Engstrom
2014/0165493 A1 6/2014 Palsson et al.
2014/0283476 A1 9/2014 Engstrom
2015/0075105 A1 3/2015 Engstrom
2015/0184397 A1 7/2015 Engstrom

(56) References Cited

U.S. PATENT DOCUMENTS

| | | | |
|---|---|---|---|
| 2016/0040438 | A1 | 2/2016 | Engstrom |
| 2016/0069087 | A1 | 3/2016 | Engstrom |

FOREIGN PATENT DOCUMENTS

| | | | |
|---|---|---|---|
| AU | 1309883 | A | 10/1983 |
| AU | 199732569 | | 12/1999 |
| AU | 200020703 | | 6/2000 |
| BE | 417526 | | 12/1936 |
| BE | 556860 | A | 5/1957 |
| BE | 557844 | | 3/1960 |
| BE | 765817 | A2 | 9/1971 |
| BE | 1010339 | | 6/1998 |
| BE | 1010487 | | 10/1998 |
| CA | 991373 | | 6/1976 |
| CA | 1049736 | A1 | 3/1979 |
| CA | 1169106 | | 6/1984 |
| CA | 1325873 | C | 1/1994 |
| CA | 2226286 | | 12/1997 |
| CA | 2252791 | | 5/1999 |
| CA | 2162836 | C | 6/1999 |
| CA | 2289309 | | 11/1999 |
| CA | 2150384 | C | 4/2005 |
| CH | 200949 | | 1/1939 |
| CH | 211677 | | 1/1941 |
| CH | 211877 | | 1/1941 |
| CH | 562 377 | | 5/1975 |
| CH | 640455 | A5 | 1/1984 |
| CN | 1054215 | A | 9/1991 |
| CN | 2091909 | U | 1/1992 |
| CN | 1115351 | A | 1/1996 |
| CN | 1124941 | A | 6/1996 |
| CN | 2242278 | Y | 12/1996 |
| DE | 209979 | | 11/1906 |
| DE | 1212275 | | 3/1966 |
| DE | 1934295 | U | 3/1966 |
| DE | 1985418 | | 5/1968 |
| DE | 1534802 | | 4/1970 |
| DE | 7102476 | | 6/1971 |
| DE | 1658875 | B1 | 9/1971 |
| DE | 2007129 | A1 | 9/1971 |
| DE | 1534278 | | 11/1971 |
| DE | 2139283 | A1 | 2/1972 |
| DE | 2101782 | | 7/1972 |
| DE | 2102537 | A1 | 8/1972 |
| DE | 2145024 | | 3/1973 |
| DE | 2159042 | | 6/1973 |
| DE | 2205232 | A1 | 8/1973 |
| DE | 2238660 | | 2/1974 |
| DE | 2251762 | | 5/1974 |
| DE | 2252643 | A1 | 5/1974 |
| DE | 7402354 | | 5/1974 |
| DE | 2502992 | | 7/1976 |
| DE | 252622 | A1 | 5/1977 |
| DE | 2616077 | | 10/1977 |
| DE | 2802151 | A1 | 7/1979 |
| DE | 2917025 | | 11/1980 |
| DE | 2916482 | A1 | 12/1980 |
| DE | 2927425 | A1 | 1/1981 |
| DE | 3104519 | | 2/1981 |
| DE | 2940945 | A1 | 4/1981 |
| DE | 3041781 | | 6/1982 |
| DE | 3046618 | A1 | 7/1982 |
| DE | 3117605 | A1 | 11/1982 |
| DE | 3214207 | | 11/1982 |
| DE | 3246376 | | 6/1984 |
| DE | 3304992 | | 8/1984 |
| DE | 3306609 | | 9/1984 |
| DE | 3319235 | | 11/1984 |
| DE | 3343601 | | 6/1985 |
| DE | 3412882 | A1 | 10/1985 |
| DE | 8604004 | | 4/1986 |
| DE | 3512204 | | 10/1986 |
| DE | 3544845 | | 6/1987 |
| DE | 3631390 | | 12/1987 |
| DE | 3640822 | | 6/1988 |
| DE | 3741041 | A1 | 9/1988 |
| DE | 8600241 | | 4/1989 |
| DE | 3933611 | A1 | 4/1991 |
| DE | 4002547-0 | | 8/1991 |
| DE | 4105207 | A1 | 8/1991 |
| DE | 3932980 | | 11/1991 |
| DE | 4130115 | A1 | 3/1993 |
| DE | 9300306 | | 3/1993 |
| DE | 4134452 | | 4/1993 |
| DE | 4215273 | | 11/1993 |
| DE | 4242530 | | 6/1994 |
| DE | 43 44 089 | | 7/1994 |
| DE | 4313037 | C1 | 8/1994 |
| DE | 9317191 | | 3/1995 |
| DE | 4402352 | A1 | 8/1995 |
| DE | 19503948 | A1 | 8/1996 |
| DE | 29520966 | U1 | 8/1996 |
| DE | 296 14 086 | | 10/1996 |
| DE | 19601322 | A1 | 5/1997 |
| DE | 29703962 | | 6/1997 |
| DE | 29710175 | | 8/1997 |
| DE | 29711960 | | 10/1997 |
| DE | 19651149 | | 6/1998 |
| DE | 19704292 | A1 | 8/1998 |
| DE | 19709641 | | 9/1998 |
| DE | 19718319 | A1 | 11/1998 |
| DE | 19821938 | | 11/1999 |
| DE | 19851200 | C1 | 3/2000 |
| DE | 20001225 | | 7/2000 |
| DE | 19940837 | A1 | 11/2000 |
| DE | 19925248 | | 12/2000 |
| DE | 20018284 | | 1/2001 |
| DE | 19933343 | A1 | 2/2001 |
| DE | 20017461 | | 2/2001 |
| DE | 20027461 | | 3/2001 |
| DE | 19963203 | A1 | 9/2001 |
| DE | 100 01 076 | | 10/2001 |
| DE | 517353 | | 5/2002 |
| DE | 20203311 | U1 | 5/2002 |
| DE | 10062873 | | 7/2002 |
| DE | 202 06 751 | U1 | 8/2002 |
| DE | 10120062 | A1 | 11/2002 |
| DE | 10131248 | | 1/2003 |
| DE | 10242647 | A1 | 6/2004 |
| DE | 10 2004 055 951 | A1 | 7/2005 |
| DE | 10 2005 002 297.9 | | 8/2005 |
| DE | 10 2007 035 648 | | 1/2009 |
| DE | 2009 022 483.1 | | 5/2009 |
| DE | 20 2009 004 530 | | 6/2009 |
| DE | 10 2010 004717.1 | | 1/2010 |
| DE | 10 2010 020 089.1 | | 5/2010 |
| DE | 10 2009 022 483 | A1 | 12/2010 |
| DE | 10 2009 038 750 | | 3/2011 |
| DE | 20 2004 021 867 | | 12/2011 |
| EP | 0024360 | A1 | 3/1981 |
| EP | 0044371 | A1 | 1/1982 |
| EP | 0085196 | | 8/1983 |
| EP | 0117707 | A2 | 9/1984 |
| EP | 0161233 | A1 | 11/1985 |
| EP | 0196672 | A2 | 10/1986 |
| EP | 0248127 | | 12/1987 |
| EP | 0256189 | A1 | 2/1988 |
| EP | 0279278 | A2 | 8/1988 |
| EP | 0335778 | A2 | 10/1989 |
| EP | 0401146 | A1 | 12/1990 |
| EP | 0220389 | | 5/1992 |
| EP | 0487925 | A1 | 6/1992 |
| EP | 0508083 | A1 | 10/1992 |
| EP | 0508260 | A2 | 10/1992 |
| EP | 0562402 | A1 | 9/1993 |
| EP | 0604896 | A1 | 7/1994 |
| EP | 0623724 | | 11/1994 |
| EP | 0652332 | A1 | 5/1995 |
| EP | 0652340 | | 5/1995 |
| EP | 0690185 | A1 | 1/1996 |
| EP | 0698162 | | 2/1996 |
| EP | 000711886 | | 5/1996 |
| EP | 0715037 | A1 | 6/1996 |

(56) References Cited

FOREIGN PATENT DOCUMENTS

| | | | |
|---|---|---|---|
| EP | 0799679 | A2 | 10/1997 |
| EP | 813641 | | 12/1997 |
| EP | 0813641 | A1 | 12/1997 |
| EP | 0843763 | | 5/1998 |
| EP | 0849416 | | 6/1998 |
| EP | 0855482 | | 7/1998 |
| EP | 0877130 | | 11/1998 |
| EP | 0903451 | | 3/1999 |
| EP | 0906994 | A1 | 4/1999 |
| EP | 0958441 | | 11/1999 |
| EP | 0969163 | | 1/2000 |
| EP | 0969164 | | 1/2000 |
| EP | 0974713 | | 1/2000 |
| EP | 1045083 | A1 | 10/2000 |
| EP | 1120515 | A1 | 8/2001 |
| EP | 1146182 | A2 | 10/2001 |
| EP | 1229181 | | 8/2002 |
| EP | 1262608 | A2 | 12/2002 |
| EP | 1279778 | A2 | 1/2003 |
| EP | 1308577 | A2 | 5/2003 |
| EP | 1350904 | A2 | 10/2003 |
| EP | 1359266 | A2 | 11/2003 |
| EP | 1367194 | A2 | 12/2003 |
| EP | 1420125 | A2 | 5/2004 |
| EP | 1437457 | A2 | 7/2004 |
| EP | 2400076 | | 8/2004 |
| EP | 2 034 106 | | 3/2009 |
| FI | 843060 | | 8/1984 |
| FR | 557844 | | 8/1923 |
| FR | 1175582 | | 3/1959 |
| FR | 1215852 | | 4/1960 |
| FR | 1293043 | | 5/1962 |
| FR | 1372596 | A1 | 9/1964 |
| FR | 1511292 | A | 1/1968 |
| FR | 2209024 | A1 | 6/1974 |
| FR | 2268922 | A1 | 11/1975 |
| FR | 2278876 | A1 | 2/1976 |
| FR | 2345560 | A1 | 10/1977 |
| FR | 2362254 | A1 | 3/1978 |
| FR | 2416988 | A1 | 9/1979 |
| FR | 2445874 | A1 | 8/1980 |
| FR | 2568295 | | 1/1986 |
| FR | 2630149 | | 10/1989 |
| FR | 2637932 | | 4/1990 |
| FR | 2675174 | | 10/1992 |
| FR | 2691491 | | 11/1993 |
| FR | 2891491 | | 11/1993 |
| FR | 2691691 | | 12/1993 |
| FR | 2697275 | | 4/1994 |
| FR | 2712329 | | 5/1995 |
| FR | 2781513 | | 1/2000 |
| FR | 2785633 | | 5/2000 |
| FR | 2810060 | | 12/2001 |
| GB | 240629 | A | 10/1925 |
| GB | 356270 | A | 9/1931 |
| GB | 424057 | | 2/1935 |
| GB | 448329 | A | 6/1936 |
| GB | 471438 | A | 9/1937 |
| GB | 585205 | | 1/1947 |
| GB | 589635 | A | 6/1947 |
| GB | 599793 | | 3/1948 |
| GB | 636423 | | 4/1950 |
| GB | 647812 | A | 12/1950 |
| GB | 812671 | | 4/1959 |
| GB | 875327 | A | 8/1961 |
| GB | 1027709 | A | 4/1966 |
| GB | 1039949 | A | 8/1966 |
| GB | 1127915 | A | 9/1968 |
| GB | 1161838 | A | 8/1969 |
| GB | 1171337 | A | 11/1969 |
| GB | 1183401 | A | 3/1970 |
| GB | 1191656 | A | 5/1970 |
| GB | 1212983 | | 11/1970 |
| GB | 1237744 | | 6/1971 |
| GB | 1275511 | A | 5/1972 |
| GB | 1308011 | A | 2/1973 |
| GB | 1348272 | | 3/1974 |
| GB | 1430423 | | 3/1976 |
| GB | 1445687 | A | 8/1976 |
| GB | 1485419 | A | 9/1977 |
| GB | 2117813 | | 10/1983 |
| GB | 2124672 | A | 2/1984 |
| GB | 2126106 | | 3/1984 |
| GB | 2142670 | | 1/1985 |
| GB | 2168732 | | 6/1986 |
| GB | 2167465 | | 1/1989 |
| GB | 2221740 | A | 2/1990 |
| GB | 2228753 | | 9/1990 |
| GB | 2240039 | A | 7/1991 |
| GB | 2243381 | | 10/1991 |
| GB | 2256023 | | 11/1992 |
| GB | 2325342 | A | 11/1998 |
| GB | 2365880 | A | 2/2002 |
| IT | 444123 | | 1/1949 |
| IT | 812671 | | 4/1959 |
| JP | 5465528 | | 5/1979 |
| JP | 57119056 | | 7/1982 |
| JP | 59041560 | A | 3/1984 |
| JP | 59186336 | | 12/1984 |
| JP | 64-14838 | | 1/1989 |
| JP | 64-14839 | | 1/1989 |
| JP | 1178659 | | 7/1989 |
| JP | H 01178659 | A | 7/1989 |
| JP | 02285145 | | 11/1990 |
| JP | H 02285145 | A | 11/1990 |
| JP | 3-18343 | | 2/1991 |
| JP | 3-44645 | | 4/1991 |
| JP | 3046645 | | 4/1991 |
| JP | 3-110258 | | 5/1991 |
| JP | H 03110258 | A | 6/1991 |
| JP | 3169967 | | 7/1991 |
| JP | 3-202550 | | 9/1991 |
| JP | 4106264 | | 4/1992 |
| JP | 4191001 | | 7/1992 |
| JP | H 04191001 | A | 7/1992 |
| JP | 04261955 | | 9/1992 |
| JP | H 0518028 | A | 1/1993 |
| JP | 5148984 | | 6/1993 |
| JP | 6-146553 | | 5/1994 |
| JP | 6200611 | A | 7/1994 |
| JP | 656310 | | 8/1994 |
| JP | 6315944 | A | 11/1994 |
| JP | 6320510 | | 11/1994 |
| JP | 752103 | | 2/1995 |
| JP | 407052103 | | 2/1995 |
| JP | 7076923 | | 3/1995 |
| JP | 7180333 | | 7/1995 |
| JP | 7189466 | A | 7/1995 |
| JP | 7229276 | | 8/1995 |
| JP | H 07229276 | A | 8/1995 |
| JP | 7279366 | | 10/1995 |
| JP | H 07279366 | A | 10/1995 |
| JP | 7300979 | | 11/1995 |
| JP | 7310426 | | 11/1995 |
| JP | 961207 | | 2/1996 |
| JP | H 0874405 | A | 3/1996 |
| JP | 8086078 | | 4/1996 |
| JP | 8109734 | A | 4/1996 |
| JP | H 0886078 | A | 4/1996 |
| JP | 8270193 | A | 10/1996 |
| JP | H 08268344 | A | 10/1996 |
| JP | H 0938906 | A | 2/1997 |
| JP | H 0988315 | A | 3/1997 |
| JP | H 09256603 | A | 9/1997 |
| JP | H 10219975 | A | 8/1998 |
| JP | 5154806 | B2 | 8/2008 |
| JP | 4203141 | B2 | 12/2008 |
| JP | 5304714 | B2 | 10/2013 |
| KR | 9533446 | A | 12/1995 |
| NL | 7601773 | | 2/1975 |
| NO | 157871 | | 7/1984 |
| NO | 305614 | | 5/1995 |
| PL | 26931 | | 6/1989 |
| SE | 372051 | | 12/1974 |

(56) References Cited

FOREIGN PATENT DOCUMENTS

| | | | |
|---|---|---|---|
| SE | 7114900-9 | | 12/1974 |
| SE | 7706470 | | 12/1978 |
| SE | 450141 | | 6/1987 |
| SE | 8206934-5 | | 6/1987 |
| SE | 457737 | | 1/1989 |
| SE | 462809 | | 4/1990 |
| SE | 467150 | | 6/1992 |
| SE | 501014 | | 10/1994 |
| SE | 9301595-6 | | 10/1994 |
| SE | 9500810 | | 3/1995 |
| SE | 502994 | | 3/1996 |
| SE | 503861 | | 9/1996 |
| SE | 509059 | | 11/1998 |
| SE | 509060 | | 11/1998 |
| SE | 512290 | | 2/2000 |
| SE | 512313 | | 2/2000 |
| SE | 513189 | | 7/2000 |
| SE | 514645 | | 3/2001 |
| SE | 0001149 | | 10/2001 |
| SU | 363795 | | 11/1973 |
| SU | 857393 | A1 | 8/1981 |
| WO | WO 80/02155 | | 10/1980 |
| WO | WO 82/00313 | A1 | 2/1982 |
| WO | WO 84/02155 | | 6/1984 |
| WO | WO 8703839 | | 7/1987 |
| WO | WO 90/00656 | A1 | 1/1990 |
| WO | WO 92/12074 | A2 | 7/1992 |
| WO | WO 9217657 | | 10/1992 |
| WO | WO 93/13280 | | 7/1993 |
| WO | WO 93/19910 | A1 | 10/1993 |
| WO | WO 9401628 | | 1/1994 |
| WO | WO 94/04773 | A1 | 3/1994 |
| WO | WO 94/22678 | A1 | 10/1994 |
| WO | WO 9426999 | | 11/1994 |
| WO | WO 95/05274 | A1 | 2/1995 |
| WO | WO 95/06176 | A1 | 3/1995 |
| WO | WO 95/14834 | A1 | 6/1995 |
| WO | WO 96/12857 | | 5/1996 |
| WO | WO 96/23942 | | 8/1996 |
| WO | WO 9627719 | | 9/1996 |
| WO | WO 9627721 | | 9/1996 |
| WO | WO 9630177 | | 10/1996 |
| WO | WO 9747834 | | 12/1997 |
| WO | WO 98/22677 | A1 | 5/1998 |
| WO | WO 9822678 | | 5/1998 |
| WO | WO 9824994 | | 6/1998 |
| WO | WO 9824995 | | 6/1998 |
| WO | WO 9858142 | | 12/1998 |
| WO | WO 9901628 | | 1/1999 |
| WO | WO 99/13179 | A1 | 3/1999 |
| WO | WO 9940273 | | 8/1999 |
| WO | WO 9966151 | | 12/1999 |
| WO | WO 9966152 | | 12/1999 |
| WO | WO 0006854 | | 2/2000 |
| WO | WO 00/20705 | | 4/2000 |
| WO | WO 00/20706 | A1 | 4/2000 |
| WO | WO 00/47841 | | 8/2000 |
| WO | WO 0056802 | | 9/2000 |
| WO | WO 0063510 | | 10/2000 |
| WO | WO 0066856 | | 11/2000 |
| WO | WO 01/02669 | | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 0002214 | | 3/2001 |
| WO | WO 0120101 | | 3/2001 |
| WO | WO 01/31141 | | 5/2001 |
| WO | WO 01/48332 | A1 | 7/2001 |
| WO | WO 01/51732 | | 7/2001 |
| WO | WO 01/51733 | | 7/2001 |
| WO | WO 01/53628 | A1 | 7/2001 |
| WO | WO 01/66877 | A1 | 9/2001 |
| WO | WO 01/75247 | | 10/2001 |
| WO | WO 01/88306 | A1 | 11/2001 |
| WO | WO 01/88307 | A1 | 11/2001 |
| WO | WO 01/96688 | A1 | 12/2001 |
| WO | WO 01/98604 | A1 | 12/2001 |
| WO | WO 02/055809 | A1 | 7/2002 |
| WO | WO 02/055810 | A1 | 7/2002 |
| WO | WO 2007/089186 | | 8/2002 |
| WO | WO 02/081843 | | 10/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/078761 | A1 | 9/2003 |
| WO | WO 03/083234 | | 10/2003 |
| WO | WO 03/087497 | A1 | 10/2003 |
| WO | WO 03/089736 | A1 | 10/2003 |
| WO | WO 03093686 | | 11/2003 |
| WO | WO 2004/016877 | A1 | 2/2004 |
| WO | WO 2004/020764 | A1 | 3/2004 |
| WO | WO 2004/081316 | A1 | 9/2004 |
| WO | WO 2004/085765 | A1 | 10/2004 |
| WO | WO 2005/040521 | | 5/2005 |
| WO | WO 2005/054599 | | 6/2005 |
| WO | WO 2005/054599 | A1 | 6/2005 |
| WO | WO 2005/059269 | | 6/2005 |
| WO | WO 2006/043893 | | 4/2006 |
| WO | WO 2006/104436 | A1 | 10/2006 |
| WO | WO 2007/008139 | | 1/2007 |
| WO | WO 2007/141605 | | 12/2007 |
| WO | WO 2008/004960 | | 1/2008 |
| WO | WO 2008/068245 | | 6/2008 |
| WO | WO 2009/066153 | | 5/2009 |
| WO | WO 2009/116926 | A1 | 9/2009 |
| WO | WO 2009/139687 | | 11/2009 |
| WO | WO 2010/082171 | | 7/2010 |
| WO | WO 2010/108980 | A1 | 9/2010 |
| WO | WO 2010/136171 | | 12/2010 |
| WO | WO 2011/085788 | | 7/2011 |
| WO | WO 2011/085825 | A1 | 7/2011 |
| WO | WO 2011/087425 | A1 | 7/2011 |
| WO | WO 2011/096879 | A1 | 8/2011 |
| WO | WO 2011/141043 | | 11/2011 |

OTHER PUBLICATIONS

Traditional Details; For Building Restoration, Renovation, and Rehabilitation: From the 1932-1951 Editions of Architectvral Graphic Standards; John Wiley & Sons, Inc.

Traindustrins Handbok "Snickeriarbete", Knut Larsson, Tekno's Handbocker Publikation 12-11 (1952).

Elements of Rolling Practice; The United Steel Companies Limited Sheffield, England, 1963; pp. 116-117.

Die mobile; Terbrack; 1968.

High-Production Roll Forming; Society of Manufacturing Engineers Marketing Services Depmiment; pp. 189-192; George T. Halmos; 1983.

Fundamentals of Building Construction Materials and Methods; Copyright 1985; pp. 11.

Automated Program of Designing Snap-fits; Aug. 1987; pp. 3.

Plastic Part Technology; 1991; pp. 161-162.

Technoscope; Modern Plastics, Aug. 1991; pp. 29-30.

Encyclopedia of Wood Joints; A Fine Woodworking Book; pp. 1-151; 1992.

Whittington's Dictionary of Plastics; Edited by James F. Carley, Ph.D., PE; pp. 443, 461; 1993.

Focus, Information Till Ana Medabetare, Jan. 2001, Kahrs pa Domotex I Hmmover, Tysklm1d, Jan. 13-16, 2001.

Search Report dated Apr. 21, 2001.

Letter to the USPTO dated May 14, 2002, regarding U.S. Appl. No. 90/005,744.

Non-Final Office Action for U.S. Appl. No. 10/270,163 dated Dec. 10, 2004.

Final Office Action for U.S. Appl. No. 10/270,163 dated Jun. 2, 2005.

Non-Final Office Action for U.S. Appl. No. 10/270,163 dated Dec. 14, 2005.

(56) References Cited

OTHER PUBLICATIONS

Final Office Action for U.S. Appl. No. 10/270,163 dated May 25, 2006.
Non-Final Office Action for U.S. Appl. No. 11/185,724 dated Sep. 26, 2006.
Non-Final Office Action for U.S. Appl. No. 11/483,636 dated Oct. 11, 2006.
Reexamination No. 90/007,366 dated Oct. 24, 2006.
Reexamination No. 90/007, 366 dated Oct. 24, 2006.
Non-Final Office Action for U.S. Appl. No. 11/185,724 dated Apr. 19, 2007.
Non-Final Office Action for U.S. Appl. No. 11/483,636 dated Apr. 19, 2007.
Non-Final Office Action for U.S. Appl. No. 11/015,741 dated Sep. 6, 2007.
Non-Final Office Action for U.S. Appl. No. 11/242,127 dated Nov. 1, 2007.
Non-Final Office Action for U.S. Appl. No. 11/185,724 dated Jan. 9, 2008.
Final Office Action for U.S. Appl. No. 11/015,741 dated Feb. 26, 2008.
Non-Final Office Action for U.S. Appl. No. 11/483,636 dated Apr. 3, 2008.
Non-Final Office Action for U.S. Appl. No. 11/242,127 dated Apr. 29, 2008.
United States District Court Eastern District of Wisconsin; Order; Dated May 1, 2008.
Examiner Interview Summary for U.S. Appl. No. 11/015,741 dated May 7, 2008.
Final Office Action for U.S. Appl. No. 11/185,724 dated Jul. 9, 2008.
Non-Final Office Action for U.S. Appl. No. 10/580,191 dated Jul. 16, 2008.
Rexamination No. 90/007,365 dated Aug. 5, 2008.
United States District Court Eastern District of Wisconsin; Judgment; Dated Oct. 10, 2008.
United States District Court Eastern District of Wisconsin; Order; Dated Oct. 10, 2008.
Final Office Action for U.S. Appl. No. 11/483,636 dated Nov. 20, 2008.
United States District Court Eastern District of Wisconsin; Order; Dated Dec. 31, 2008.
Non-Final Office Action for U.S. Appl. No. 11/242,127 dated Mar. 31, 2009.
Non-Final Office Action for U.S. Appl. No. 12/010,587 dated Jun. 23, 2009.
Non-Final Office Action for U.S. Appl. No. 11/483,636 dated Jul. 21, 2009.
Examiner Interview Summary for U.S. Appl. No. 11/185,724 dated Aug. 13, 2009.
Non-Final Office Action for U.S. Appl. No. 12/278,274 dated Sep. 24, 2009.
Final Office Action for U.S. Appl. No. 11/242,127 dated Nov. 24, 2009.
United States Court of Appeals for Federal Circuit; 2009-1107,—1122; Decided: Feb. 18, 2010.
Appeals from the United States District Court for the Eastern District of Wisconsin; Consolidated case No. 02-CV-0736 and 03-CV-616; Judge J.P. Stadtmueller, 2009-1107,—1122. Revised Feb. 25, 2010.
Non-Final Office Action for U.S. Appl. No. 10/580,191 dated Mar. 10, 2010.
Non-Final Office Action for U.S. Appl. No. 11/483,636 dated Mar. 17, 2010.
United States Court of Appeals of the Federal Circuit; Case No. 02-CV-0736 and 03-CV-616; Mandate issued on Apr. 12, 2010; Judgment; 2 pages.
Final Office Action for U.S. Appl. No. 12/278,274 dated May 17, 2010.
Final Office Action for U.S. Appl. No. 12/010,587 dated May 25, 2010.
Final Office Action for U.S. Appl. No. 10/580,191 dated Oct. 6, 2010.
Non-Final Office Action for U.S. Appl. No. 12/278,274 dated Nov. 2, 2010.
Non-Final Office Action for U.S. Appl. No. 11/483,636 dated Dec. 7, 2010.
Non-Final Office Action for U.S. Appl. No. 12/010,587 dated Mar. 16, 2011.
International Search Report for Application No. PCT/EP2010/006772 dated Mar. 31, 2011.
Final Office Action for U.S. Appl. No. 12/278,274 dated Apr. 14, 2011.
Final Office Action for U.S. Appl. No. 11/483,636 dated May 24, 2011.
Non-Final Office Action for U.S. Appl. No. 13/048,646 dated May 25, 2011.
Non-Final Office Action for U.S. Appl. No. 12/966,861 dated Jul. 20, 2011.
Non-Final Office Action for U.S. Appl. No. 12/979,086 dated Aug. 3, 2011.
Non-Final Office Action for U.S. Appl. No. 12/010,587 dated Aug. 30 ,2011.
Non-Final Office Action for U.S. Appl. No. 11/483,636 dated Sep. 28, 2011.
Decision revoking the European Patent EP-B-1 276 941 dated Oct. 21, 2011.
Final Office Action for U.S. Appl. No. 13/048,646 dated Nov. 1, 2011.
Final Office Action for U.S. Appl. No. 12/966,861 dated Jan. 20, 2012.
Final Office Action for U.S. Appl. No. 12/979,086 dated Jan. 25, 2012.
Final Office Action for U.S. Appl. No. 11/483,636 dated Feb. 7, 2012.
Non-Final Office Action for U.S. Appl. No. 12/966,797 dated Feb. 29, 2012.
Final Office Action for U.S. Appl. No. 13/204,481 dated Mar. 12, 2012.
Notice of Allowance for U.S. Appl. No. 12/966,861 dated Apr. 11, 2012.
Non-Final Office Action for U.S. Appl. No. 13/437,597 dated Jul. 9, 2012.
Notice of Allowance for U.S. Appl. No. 12/979,086 dated Jul. 19, 2012.
Non-final Office Action for U.S. Appl. No. 12/747,454 dated Aug. 6, 2012.
Final Office Action for U.S. Appl. No. 12/966,797 dated Aug. 8, 2012.
Non-Final Office Action for U.S. Appl. No. 13/452,183 dated Aug. 8, 2012.
Non-Final Office Action for U.S. Appl. No. 13/204,481 dated Sep. 7, 2012.
Non-Final Office Action for U.S. Appl. No. 13/567,933 dated Sep. 12, 2012.
Non-Final Office Action for U.S. Appl. No. 11/483,636 dated Oct. 10, 2012.
Advisory Action for U.S. Appl. No. 12/966,797 dated Oct. 18, 2012.
European Office Action dated Oct. 19, 2012.
Notice of Allowance for U.S. Appl. No. 13/437,597 dated Oct. 26, 2012.
Non-Final Office Action for U.S. Appl. No. 13/086,931 dated Nov. 7, 2012.
Non-Final Office Action for U.S. Appl. No. 13/492,512 dated Nov. 21, 2012.
Non-Final Office Action for U.S. Appl. No. 13/463,329 dated Nov. 21, 2012.
Notice of Allowance for U.S. Appl. No. 11/483,636 dated Nov. 23, 2012.
Notice of Allowance for U.S. Appl. No. 10/270,163 dated Dec. 13, 2012.

(56) References Cited

OTHER PUBLICATIONS

Non-Final Office Action for U.S. Appl. No. 12/966,797 dated Dec. 13, 2012.
Non-Final Office Action for U.S. Appl. No. 13/559,230 dated Dec. 20, 2012.
Non-Final Office Action for U.S. Appl. No. 13/675,936 dated Dec. 31, 2012.
Notice of Allowability for U.S. Appl. No. 11/483,636 dated Jan. 3, 2013.
Notice of Allowance for U.S. Appl. No. 12/747,454 dated Jan. 8, 2013.
Notice of Allowance for U.S. Appl. No. 13/437,597 dated Jan. 9, 2013.
Final Office Action for U.S. Appl. No. 12/010,587 dated Jan. 28, 2013.
Non-Final Office Action for U.S. Appl. No. 13/620,098 dated Feb. 8, 2013.
Final Office Action for U.S. Appl. No. 13/204,481 dated Feb. 25, 2013.
Non-Final Office Action for U.S. Appl. No. 13/492,512 dated Feb. 26, 2013.
Non-Final Office Action for U.S. Appl. No. 11/015,741 dated Mar. 13, 2013.
Final Office Action for U.S. Appl. No. 13/567,933 dated Mar. 15, 2013.
Notice of Allowance for U.S. Appl. No. 11/242,127 dated Apr. 26, 2013.
Notice of Allowance for U.S. Appl. No. 13/437,597 dated Apr. 29, 2013.
Non-Final Office Action for U.S. Appl. No. 12/747,454 dated May 10, 2013.
Notice of Allowance for U.S. Appl. No. 11/185,724 dated May 20, 2013.
Non-Final Office Action for U.S. Appl. No. 13/559,242 dated Jun. 7, 2013.
Applicant-Iniated Interview Summary for U.S. Appl. No. 13/204,481 dated Jul. 29, 2013.
Corrected Notice of Allowability for U.S. Appl. No. 11/185,724 dated Aug. 1, 2013.
Final Office Action for U.S. Appl. No. 13/086,931 dated Aug. 5, 2013.
Notice of Allowance for U.S. Appl. No. 12/966,797 dated Aug. 7, 2013.
Notice of Allowance for U.S. Appl. No. 12/010,587 dated Aug. 14, 2013.
Notice of Allowance for U.S. Appl. No. 13/559,230 dated Aug. 20, 2013.
Non-Final Office Action for U.S. Appl. No. 13/860,315 dated Aug. 26, 2013.
Notice of Allowance for U.S. Appl. No. 11/185,724 dated Sep. 3, 2013.
Non-Final Office Action for U.S. Appl. No. 13/204,481 dated Sep. 4, 2013.
Final Office Action for U.S. Appl. No. 13/620,098 dated Sep. 24, 2013.
Non-Final Office Action for U.S. Appl. No. 13/463,329 dated Sep. 25, 2013.
Notice of Allowance for U.S. Appl. No. 13/675,936 dated Sep. 25, 2013.
Supplemental Notice of Allowance for U.S. Appl. No. 12/966,797 dated Oct. 3, 2013.
Supplemental Notice of Allowance for U.S. Appl. No. 13/559,230 dated Oct. 4, 2013.
Notice of Allowance for U.S. Appl. No. 11/185,724 dated Nov. 1, 2013.
Final Office Action for U.S. Appl. No. 12/747,454 dated Nov. 6, 2013.
Notice of Allowance for U.S. Appl. No. 13/086,931 dated Nov. 19, 2013.
Architectvral Graphic Standards; Jolm Wiley & Sons, Inc.
Bojlesystemet til Junckers boliggulve, Junckers Trae for Livet.
CLIC, Ali-Nr, 110 11 640.
Fibolic Brochure, undated.
Fiboloc Literature, Mar. 1999.
FN Neuhofer Holz, "Profiles in various kinds and innovative accessories"; Certified according to DIN EN ISO 9002.
Haro Wand and Decke.
Hot Rolling Of Steel; Library of Congress Cataloging in Publication Data; Roberts, William L; p. 189.
International Search Report.
Laminat-Boden, Clever-Clickq.
New Software Simplifies Snap-Fit Design; Design News; p. 148.
Opplaering OG Autorisasjon, Fibo-Trespo, ALLOC, Lmninatgulvet som Legges Uter Lin.
Original Pergo the Free and Easy Floor.
Pending U.S. Appl. No. 09/672,077 (Cited As U.S. Pat. No. 6,536,178).
Pending U.S. Appl. No. 09/988,014 (Cited As US 2003/0094230).
Pending U.S. Appl. 09/770,395 (Cited As U.S. Pat. No. 6,588,166)
Pending U.S. Appl. No. 10/158,945 (Cited As U.S. Pat. No. 7,497,058).
Pending U.S. Appl. No. 09/672,076 (Cited As U.S. Pat. No. 6,591,568).
Pergo, Clic Flooring, Laminatgolv.
Plastic Product Design; Van Nostrand Reinhold Company; pp. 256-258.
Special Verdict, Civil Case No. 02-C-0736.
The Clip System for Junckers Sports Floors, Junckers Solid Hardood Flooring, Almex 7, p. 1/2.
The Clip System for Junckers Sports Floors, Junckers Solid Hardood Flooring, Annex 8, p. 1/4.
Time Life Books; "Floors, Stairs, Carpets," p. 14.
Trabearbetning Anders Gronhmd, TralelmikCentrum.
Trae Pjecer; pp. 1-35.
United States District Court Eastern of Wisconsin; Pervan Testimony; Trial Day 5 (Official Transcript); pp. 1101-1292.
United States District Court North Carolina; Pergo (Europe) AB v Unilin Beheer BV, Civil. Action No. 5:08- CV-91; Joint Stipulation of Dismissal.
United States District Court of North Carolina; Pergo (Europe) AB v Unilin Beheer BV. Civil Action No. 5:08- CV-91-H3; Plantiffs Original Complaint for Patent Infringement.
United States District Court of North Carolina; Pergo (Europe) Ab v Unilin Beheer BV. Civil Action No. 5:08- CV-91-H3: Answer and Counterclaim of Defendant.
Valinge Innovation AB; "Choosing the Locking System"
Webster's, Dictionary, p. 862, definition of scarf.
Final Office Action for U.S. Appl. No. 12/747,454 dated Feb. 24, 2014.
Supplemental Notice of Allowance for U.S. Appl. No. 13/086,931 dated Apr. 14, 2014.
Abandoned U.S. Appl. No. 13/420,282 dated Mar. 14, 2012.
European Patent Office Opposition Division Decision for Application No. 01906461.7 dated Oct. 21, 2011.
European Patent Office Board of Appeal Decision for Application No. 01906461.7 dated Jul. 24, 2014.
Patent Abstract of Japan, Publication No. 07300979, Konishi et al, Nov. 1995.
International Search Report for PCT/SE 96/00256 date Jul. 2, 1996.
Wood Handbook; Forest Products Laboratory, 1999; "Glossary pp. G-1 to G-14", "Chapter 10, pp. 10-1 to 10-31"
Non-Final Office Action for U.S. Appl. No. 10/015,741 dated Jun. 29, 2005.
Advisory Action for U.S. Appl. No. 10/270,163 dated Sep. 15, 2005.
Notice of Allowance for U.S. Appl. No. 10/015,741 dated Dec. 1, 2005.
Advisory Action for U.S. Appl. No. 10/270,163 dated Aug. 8, 2006.
International Search Report for Application No. PCT/SE007/000070 dated Mar. 30, 2007.
Restriction Requirement for U.S. Appl. No. 10/580,191 dated May 12, 2008.

(56) References Cited

OTHER PUBLICATIONS

Restriction Requirement for U.S. Appl. No. 11/242,127 dated Dec. 8, 2008.
Restriction Requirement for U.S. Appl. No. 12/010,587 dated Apr. 27, 2009.
Restriction Requirement for U.S. Appl. No. 12/010,587 dated Jan. 20, 2010.
Advisory Action for U.S. Appl. No. 11/242,127 dated Mar. 18, 2010.
Advisory Action for U.S. Appl. No. 12/010,587 dated Sep. 13, 2010.
Advisory Action for U.S. Appl. No. 12/278,274 dated Sep. 27, 2010.
Advisory Action for U.S. Appl. No. 10/580,191 dated Feb. 15, 2011.
Non-Final Office Action for U.S. Appl. No. 12/240,739 dated Oct. 5, 2011.
Restriction Requirement for U.S. Appl. No. 12/966,797 dated Jan. 31, 2012.
Notice of Allowance for U.S. Appl. No. 12/240,739 dated Feb. 2, 2012.
Final Office Action for U.S. Appl. No. 12/010,587 dated Mar. 22, 2012.
Advisory Action for Application No. 13/204,431dated May 24, 2012.
Advisory Action for U.S. Appl. No. 12/010,587 dated May 30, 2012.
Restriction Requirement for U.S. Appl. No. 13/452,183 dated Jul. 10, 2012.
Non-Final Office Action for U.S. Appl. No. 12/010,587 dated Oct. 10, 2012.
Restriction Requirement for U.S. Appl. No. 13/957,971 dated Nov. 12, 2013.
Notice of Allowance for U.S. Appl. No. 12/966,797 dated Dec. 5, 2013.
Notice of Allowance for U.S. Appl. No. 13/086,931 dated Jan. 31, 2014.
Non-Final Office Action for U.S. Appl. No. 13/957,971 dated Feb. 20, 2014.
Notice of Allowance for U.S. Appl. No. 13/086,931 dated Mar. 18, 2014.
Non-final Office Action for U.S. Appl. No. 13/620,098 dated Mar. 21, 2014.
Final Office Action for U.S. Appl. No. 13/204,481 dated Apr. 22, 2014.
Final Office Action for U.S. Appl. No. 13/463,329 dated May 16, 2014.
Restriction Requirement for U.S. Appl. No. 14/076,879 dated May 23, 2014.
Non-Final Office Action for U.S. Appl. No. 14/097,001 dated Jun. 12, 2014.
Non-Final Office Action for U.S. Appl. No. for 14/098,187 dated Jun. 16, 2014.
Notice of Allowance for U.S. Appl. No. 13/567,933 dated Jun. 17, 2014.
Non-Final Office Action for U.S. Appl. No. 14/223,365 dated Jul. 3, 2014.
Notice of Allowance for U.S. Appl. No. 13/620,098 dated Jul. 22, 2014.
Non-Final Office Action for U.S. Appl. No. 14/086,724 dated Aug. 1, 2014.
Final Office Action for U.S. Appl. No. 13/957,971 dated Sep. 3, 2014.
Non-final Office Action for U.S. Appl. No. 12/747,454 dated Sep. 12, 2014.
Notice of Allowance for U.S. Appl. No. 13/620,098 dated Sep. 18, 2014.
Non-Final Office Action for U.S. Appl. No. 14/086,757 dated Oct. 7, 2014.
Notice of Allowance for U.S. Appl. No. 13/567,933 dated Oct. 16, 2014.
Final Office Action for U.S. Appl. No. 13/204,481 dated Oct. 30, 2014.
Notice of Allowance for U.S. Appl. No. 14/223,365 dated Nov. 5, 2014.
Advisory Action for U.S. Appl. No. 13/957,971 dated Dec. 17, 2014.
Notice of Allowance for U.S. Appl. No. 14/097,001 dated Dec. 24, 2014.
Notice of Allowance for Application No. 14/098,187 dated Dec. 26, 2014.
Notice of Allowance for Application No. 13/463,329 dated Dec. 31, 2014.
Final Office Action for U.S. Appl. No. 14/086,724 dated Jan. 16, 2015.
Notice of Allowance for U.S. Appl. No. 13/860,315 dated Jan. 20, 2015.
Non-Final Office Action for U.S. Appl. No. 13/957,971 dated Jan. 30, 2015.
Notice of Allowance for U.S. Appl. No. 13/567,933 dated Feb. 4, 2015.
Notice of Allowance for US. Appl. No. 13/860,315 dated Mar. 5, 2015.
Final Office Action for U.S. Appl. No. 14/036,757 dated Mar. 17, 2015.
Non-Final Office Action for U.S. Appl. No. 13/204,481 dated Mar. 25, 2015.
Non-Final Office Action for U.S. Appl. No. 14/456,755 dated Mar. 27, 2015.
Notice of Allowance for U.S. Appl. No. 13/860,315 dated Apr. 6, 2015.
Non-Final Office Action for U.S. Appl. No. 14/044,572 dated Apr. 6, 2015.
Notice of Allowance for U.S. Appl. No. 14/098,187 dated Apr. 8, 2015.
Notice of Allowance for U.S. Appl. No. 14/086,724 dated Apr. 15, 2015.
Notice of Allowance for U.S. Appl. No. 14/097,001 dated Apr. 15, 2015.
Non-Final Office Action for U.S. Appl. No. 14/658,954 dated Apr. 24, 2015.
Notice of Allowance for U.S. Appl. No. 13/048.646 dated May 14, 2015.
Notice of Allowance for U.S. Appl. No. 13/567,933 dated May 22, 2015.
Notice of Allowance for U.S. Appl. No. 14/086,724 dated Jun. 1, 2015.
Advisory Action for U.S. Appl. No. 14/086,757 dated Jul. 10, 2015.
Non-Final Office Action for U.S. Appl. No. 14/086,757 dated Aug. 3, 2015.
Final Office Action for U.S. Appl. No. 13/957,971 dated Aug. 6, 2015.
Notice of Allowance for U.S. Appl. No. 13/860,315 dated Aug. 21, 2015.
Notice of Allowance for U.S. Appl. No. 14/098,187 dated Sep. 10, 2015.
Notice of Allowance for U.S. Appl. No. 13/567,933 dated Sep. 15, 2015.
Notice of Allowance for U.S. Appl. No. 14/097,001 dated Sep. 16, 2015.
Final Office Action for U.S. Appl. No. 13/204,481 dated Sep. 21, 2015.
Final Office Action for U.S. Appl. No. 14/456,755 dated Oct. 27, 2015.
Final Office Action for U.S. Appl. No. 14/658,954 dated Nov. 9, 2015.
Non-Final Office Action for U.S. Appl. No. 13/492,512 dated Nov. 17, 2015.
Advisory Action for U.S. Appl. No. 13/957,971 dated Nov. 30, 2015.
Notice of Allowance for U.S. Appl. No. 13/860,315 dated Dec. 9, 2015.
Non-Final Office Action for U.S. Appl. No. 13/957,971 dated Dec. 18, 2015.
Restriction Requirement for U.S. Appl. No. 14/844,877 dated Dec. 31, 2015.

(56) References Cited

OTHER PUBLICATIONS

Non-Final Office Action for U.S. Appl. No. 14/821,29. dated Feb. 2, 2016.
Notice of Allowance for U.S. Appl. No. 13/204,481 dated Feb. 3, 2016.
Final Office Action for U.S. Appl. No. 14/086,757 dated Feb. 11, 2016.
Advisory Action for U.S. Appl. No. 14/658,954 dated Mar. 3, 2016.
Final Office Action for U.S. Appl. No. 14/044,572 dated Mar. 18, 2016.
Notice of Allowance for U.S. Appl. No. 14/456,755 dated Apr. 6, 2016.
Notice of Allowance for U.S. Appl. No. 13/957,971 dated May 9, 2016.
E1—"Versatility with the UltraLock System!" Feb. 9, 2000—Alleged Prior Art cited in European Patent Office Opposition for Application No. 01906461.7.
E2—Photographs of "Long Side" and "Short Side," Nov. 1999—Alleged Prior Art cited in European Patent Office Oppostion for Application No. 01906461.7.
E3—Affidavit; booklet titled, "Versatility with the UltraLock System!"—Alleged Prior Art cited in European Patent Office Opposition for Application No. 01906461.7.

* cited by examiner

FLOORING MATERIAL

CROSS-REFERENCE TO RELATED APPLICATIONS

This application is a continuation of and claims priority to co-pending U.S. patent application Ser. No. 12/010,587, filed Jan. 28, 2008, which is a divisional of U.S. patent application Ser. No. 10/242,674 (now U.S. Pat. No. 7,332,053), which is a continuation-in-part of U.S. patent application Ser. No. 09/988,014 (now abandoned), filed Nov. 16, 2001, and a continuation-in-part application of U.S. patent application Ser. No. 09/672,076 (now U.S. Pat. No. 6,591,568), filed Sep. 29, 2000, which claims priority to Swedish Application No. 0001149-4, filed Mar. 31, 2000. The entire disclosures of each of the above references are incorporated by reference herein in their entireties.

BACKGROUND

The present invention relates to a flooring material comprising sheet-shaped floor elements which are joined by means of joining members.

Prefabricated floor boards provided with tongue and groove at the edges are quite common nowadays. These can be installed by the average handy man as they are very easy to install. Such floors can, for example, be constituted of solid wood, fibre board or particle board. These are most often provided with a surface layer such as lacquer, or some kind of laminate. The boards are most often installed by being glued via tongue and groove. The most common types of tongue and groove are however burdened with the disadvantage to form gaps of varying width between the floor boards in cases where the installer hasn't been thorough enough. Dirt will easily collect in such gaps. Moisture will furthermore enter the gaps which will cause the core to expand in cases where it is made of wood, fibre board or particle board, which usually is the case. The expansion will cause the surface layer to rise closest to the edges of the joint which radically reduces the useful life of the floor since the surface layer will be exposed to an exceptional wear. Different types of tensioning devices, forcing the floor boards together during installation can be used to avoid such gaps. This operation is however more or less awkward. It is therefore desirable to achieve a joint which is self-guiding and thereby automatically finds the correct position. Such a joint would also be possible to utilise in floors where no glue is to be used.

Such a joint is known through WO 94/26999 which deals with a system to join two floor boards. The floor boards are provided with a locking device at the rear sides. In one embodiment the floor boards are provided with profiles on the lower side at a first long side and short side. These profiles, which extends outside the floor board itself, is provided with an upwards directed lip which fits into grooves on the lower side of a corresponding floor board. These grooves are arranged on the second short side and long side of this floor board. The floor boards are furthermore provided with a traditional tongue and groove on the edges. The intentions are that the profiles shall bend downwards and then to snap back into the groove when assembled. The profiles are integrated with the floor boards through folding or alternatively, through gluing.

According to WO 94/26999, the floor boards may be joined by turning or prizing it into position with the long side edge as a pivot point. It is then necessary to slide the floor board longitudinally so that it snaps into the floor board previously installed in the same row. A play is essential in order to achieve that. This play seems to be marked with the Greek letter Delta in the figures. A tolerance of +–0.2 mm is mentioned in the application. Such a play will naturally cause undesired gaps between the floor boards. Dirt and moisture can penetrate into these gaps.

It is also known through WO 97/47834 to manufacture a joint where the floor boards are joined by turning or prizing it into position with the long side edge as a pivot point. According to this invention a traditional tongue has been provided with heel on the lower side. The heel has a counterpart in a recess in the groove of the opposite side of the floor board. The lower cheek of the groove will be bent away during the assembly and will then snap back when the floor board is in the correct position. The snap-joining parts, i.e. the tongue and groove, is in opposite to the invention according to WO 94/26999 above, where they are constituted by separate parts, seems to be manufactured monolithically from the core of the floor board. WO 97/47834 does also show how the tongue and groove with heels and recesses according to the invention is tooled by means of cutting machining. This invention does also have the disadvantage that the best mode of joining floor boards includes longitudinal sliding for joining the short sides of the floor boards, which also here will require a play which will cause unwanted gaps between the floor boards. Dirt and moisture can penetrate into these gaps.

It is, through the present invention, made possible to solve the above mentioned problems whereby a floor element which can be assembled without having to be slid along already assembled floor elements has been achieved. It is thereby made possible to achieve tighter joints. Accordingly, the invention relates to a flooring material comprising sheet-shaped floor elements with a mainly square or rectangular shape. The floor elements are provided with edges, a lower side and an upper decorative layer. The floor elements are intended to be joined by means of joining members. The invention is characterised in that:

a) The floor elements are provided with male joining members on a first edge while a second, opposite, edge of the floor elements are provided with a female joining member. The male joining member is provided with a tongue and a lower side groove. The female joining member is provided with a groove and a cheek, the cheek being provided with a lip. The floor elements are intended to mainly be joined together by tilting the floor element to be joined with an already installed floor element or a row of already installed floor elements, with the male joining member of the floor element angled downwards and that the first edge is allowed to be mainly parallel to the second edge of the already installed floor element or elements. The tongue of the tilted floor element is then inserted into the groove of the female joining member of the already installed floor element or elements. The tilted floor element is then turned downwards, with its lower edge as a pivot axis, so that the lip eventually snaps into the lower side groove where the decorative upper layer of the floor elements are mainly parallel.

b) The floor elements are moreover provided with a male vertical assembly joining member on a third edge while a fourth edge is provided with female vertical assembly joining member. The fourth edge is arranged on a side opposite to the third edge.

c) The floor elements are alternatively provided with a male vertical assembly joining member on a third edge, while a fourth edge also is provided with male vertical assembly joining member. The fourth edge is arranged on a side opposite to the third edge. Adjacent male vertical assembly joining members are thereby joined by means of a separate vertical assembly joining profile. Two adjacent edges of a floor element can hereby be joined with a floor element adjacent to the first edge and a floor element adjacent to the third or fourth edge at the same time, and in the same turning motion.

The force needed to overcome the static friction along the joint between two completely assembled male and female joining members is preferably larger than 10N per meter of joint length, suitably larger than 100N per meter of joint length.

According to one embodiment of the invention, the floor elements are provided with male vertical assembly joining members on a third edge and provided with female vertical assembly joining members on a fourth edge. The male vertical assembly joining members are provided with mainly vertical lower cheek surfaces arranged parallel to the closest edge. The lower cheek surfaces are intended to interact with mainly vertical upper cheek surfaces arranged on the female vertical assembly joining members so that two joined adjacent floor elements are locked against each other in a horizontal direction. The male and female vertical assembly joining members are provided with one or more snapping hooks with matching under cuts which by being provided with mainly horizontal locking surfaces limits the vertical movement between two joined adjacent floor elements.

The floor elements may alternatively be provided with male vertical assembly joining members on both a third and a fourth edge. These edges are then snap joined by means of a vertical assembly profile which on both sides of a longitudinal symmetry line is designed as a female vertical assembly joining member according to the description above. Two joined adjacent floor elements are locked to each other in a horizontal direction via the vertical assembly profile while, at the same time, vertical movement between two joined adjacent floor elements is limited.

The joint between a third and a fourth edge of two joined floor elements preferably comprises contact surfaces which are constituted by the horizontal locking surfaces of the under cuts and hooks, the mainly vertical upper cheek surfaces and lower cheek surfaces as well as upper mating surfaces.

The joint between two joined floor elements suitably also comprises cavities.

According to one embodiment of the invention the snapping hook is constituted by a separate spring part which is placed in a cavity. Alternatively the undercut is constituted by a separate spring part which is placed in a cavity. The spring part is suitably constituted by an extruded thermoplastic profile, a profile of thermosetting resin or an extruded metal profile.

The vertical assembly joining profiles are suitably shaped as extended profiles which suitably are manufactured through extrusion which is a well known and rational method. The vertical assembly joining profiles are suitably shaped as extended lengths or rolls which can be cut to the desired length. The length of the vertical assembly joining profiles considerably exceeds the length of a floor element, before being cut. The lateral joints of the floor will only need shorter pieces of vertical assembly joining profiles which are positioned as each new floor board is introduced to a row. Vertical assembly joining profiles according to the present invention may be manufactured of a number of different materials and manufacturing methods. Among the most suited can, however, be mentioned injection moulding and extrusion. Suitable materials are thermoplastic materials such as polyolefins, polystyrene, polyvinyl chloride or acrylnitrile-butadiene-styrene copolymer. These may suitably be filled with, for example, wood powder or lime in order to increase the rigidity but also to increase the adhesion when glue is used. It is also possible to mill a vertical assembly joining profile from a material such as wood, fibre board or particle board.

The flooring material including the floor boards and joining profiles above is most suited when installing floors where it isn't desired to use glue. It is, however, possible to use glue or twin-faced adhesive tape in order to make the installation irreversibly permanent. The glue or tape is then suitably applied on, or in connection to, possible cavities or faces below the upper mating surfaces.

BRIEF DESCRIPTION OF THE DRAWINGS

The invention is described further in connection to enclosed figures showing different embodiments of a flooring material whereby.

DETAILED DESCRIPTION

Figure 1:
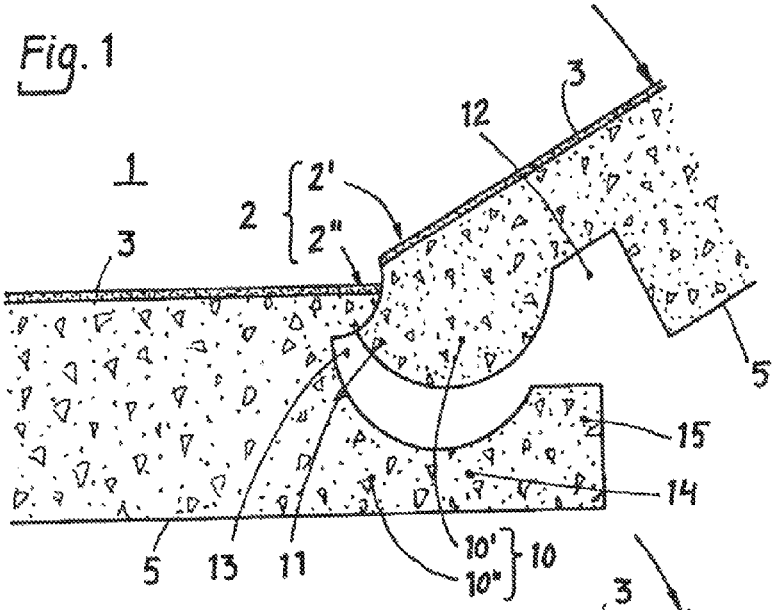
FIG. 1 shows, in cross-section, a first and a second edge $\mathbf{2}^{I}$ and $\mathbf{2}^{II}$ respectively, during joining.

Accordingly FIG. 1 shows, in cross-section, a first and a second edge $\mathbf{2}^{I}$ and $\mathbf{2}^{II}$ respectively, during assembly. The figure shows parts of a flooring material comprising sheet-shaped floor elements 1 with a mainly square or rectangular shape. The floor elements 1 are provided with edges 2, a lower side 5 and an upper decorative layer 3. The floor elements 1 are intended to be joined by means of joining members 10. The floor elements 1 are provided with male joining members $\mathbf{10}^{I}$ on a first edge $\mathbf{2}^{I}$ while a second edge $\mathbf{2}^{II}$ of the floor elements 1 are provided with a female joining member $\mathbf{10}^{II}$. The second edge $\mathbf{2}^{II}$ is arranged on a side opposite to the first edge $\mathbf{2}^{I}$. The male joining member $\mathbf{10}^{I}$ is provided with a tongue 11 and a lower side 5 groove 12. The female joining member $\mathbf{10}^{II}$ is provided with a groove 13 and a cheek 14, the cheek 14 being provided with a lip 15. The floor elements 1 are intended to mainly be joined together by tilting the floor element 1 to be joined with an already installed floor element 1 or a row of already installed floor elements 1, with the male joining member $\mathbf{10}^{I}$ of the floor element 1 angled downwards and that the first edge $\mathbf{2}^{I}$ is allowed to be mainly parallel to the second edge $\mathbf{2}^{II}$ of the already installed floor element 1 or elements 1. The tongue 11 of the tilted floor element 1 is then inserted into the groove 13 of the female joining member $\mathbf{10}^{II}$ of the already installed floor element 1 or elements 1, whereby the tilted floor element 1 is turned downwards, with its lower edge as a pivot axis, so that the lip 15 eventually falls into the lower side 5 groove 12 where the decorative upper layer 3 of the floor elements 1 are mainly parallel.

Figure 2:
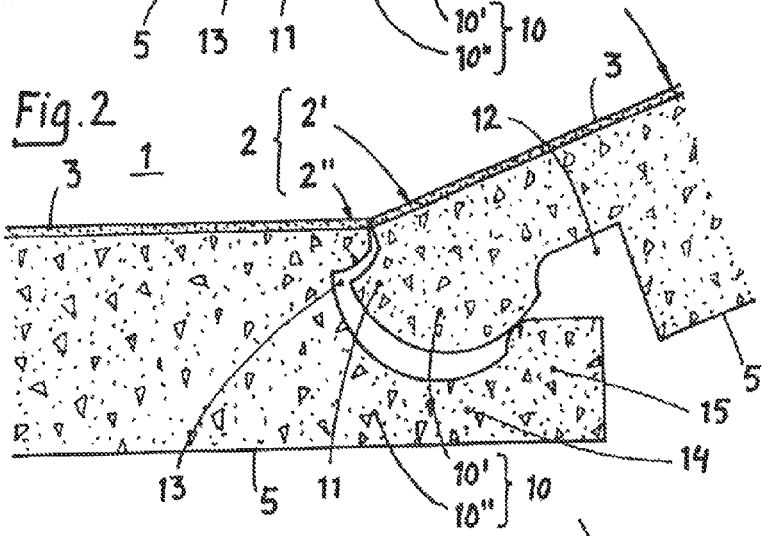
FIG. 2 shows, in cross-section, a second embodiment of a first and a second edge $\mathbf{2}^{I}$ and $\mathbf{2}^{II}$ respectively, during joining.

The embodiment shown in FIG. 2 corresponds mainly with the one shown in FIG. 1. The lip 15 and lower side 5 groove 12 are, however, provided with a cam 16 and a cam groove 17 which provides a snap action locking.

Figure 3:
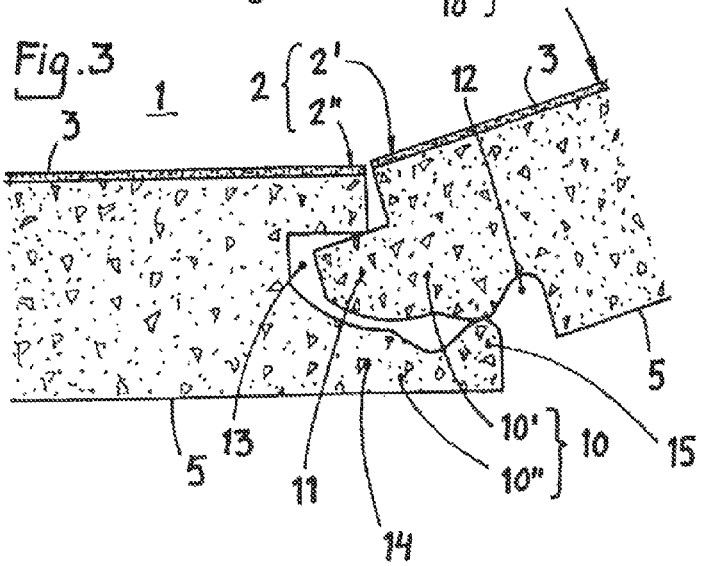
FIG. 3 shows, in cross-section, a third embodiment of a first and a second edge $\mathbf{2}^{I}$ and $\mathbf{2}^{II}$ respectively, during joining.

The embodiment shown in FIG. 3 corresponds mainly with the one shown in FIGS. 1 and 2 above. The lip 15 and lower side 5 groove 12 are, however, provided with a cam 16 and a cam groove 17 which provides a snap action locking.

Figure 4:
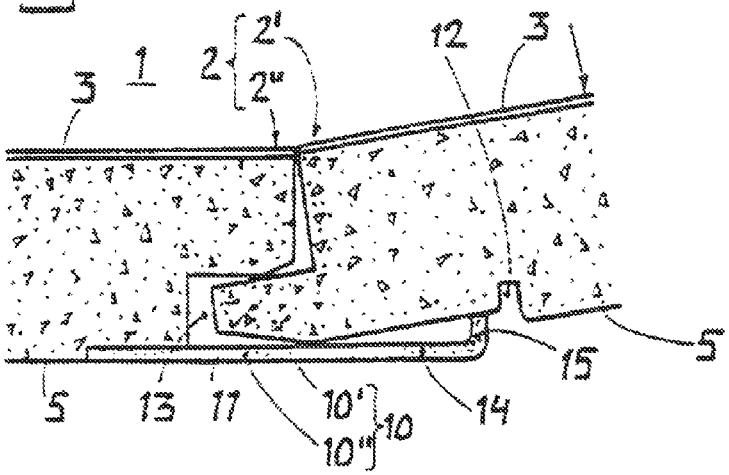
FIG. 4 shows, in cross-section, a fourth embodiment of a first and a second edge $\mathbf{2}^{I}$ and $\mathbf{2}^{II}$ respectively, during joining.

The embodiment shown in FIG. 4 corresponds mainly with the one shown in FIG. 1 above. The lip 15 and cheek 14 is however shaped as a thin resilient section which provides a snap action locking.

Figure 5:
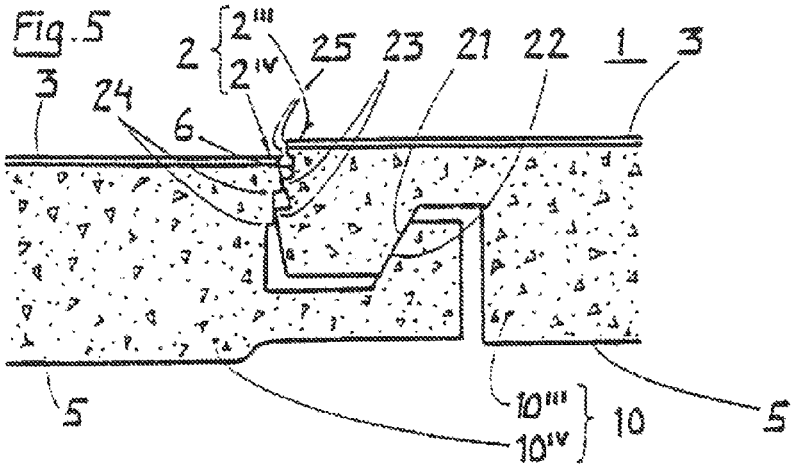
FIG. 5 shows, in cross-section, a third and a fourth edge $\mathbf{2}^{III}$ and $\mathbf{2}^{IV}$ respectively, during joining.

FIG. 5 shows, in cross-section, a third and a fourth edge $\mathbf{2}^{III}$ and $\mathbf{2}^{II}$ respectively, of a floor element 1 according to any of the FIGS. 1 to 4. The floor elements 1 are provided with a male vertical assembly joining member $\mathbf{10}^{III}$ on a third edge $\mathbf{2}^{III}$ while a fourth edge $\mathbf{2}^{IV}$ is provided with a female vertical assembly joining member $\mathbf{10}^{IV}$. The fourth edge $\mathbf{2}^{IV}$ is placed on a side opposite to the third edge $\mathbf{2}^{III}$. The male vertical assembly joining members $\mathbf{10}^{III}$ are provided with mainly vertical lower cheek surfaces 21 arranged parallel to the closest edge 2. The lower cheek surfaces 21 are intended to interact with mainly vertical upper cheek surfaces 22 arranged on the female vertical assembly joining members $\mathbf{10}^{IV}$ so that two joined adjacent floor elements 1 are locked against each other in a horizontal direction. The male vertical assembly joining members $\mathbf{10}^{III}$ are moreover provided with two snapping hooks 23 while the female vertical assembly joining members $\mathbf{10}^{IV}$ are provided with matching under cuts 24, which by being provided with mainly horizontal locking surfaces limits the vertical movement between two joined adjacent floor elements 1.

The joint between a third and a fourth edge $\mathbf{2}^{III}$ and $\mathbf{2}^{IV}$ respectively of two joined floor elements 1 further comprises contact surfaces which are constituted by the horizontal locking surfaces of the under cuts 23 and hooks 24, the mainly vertical upper cheek surfaces 22 lower cheek surfaces as well as upper mating surfaces 25. The joint between two joined floor elements 1 also comprises cavities 6.

Figure 6:
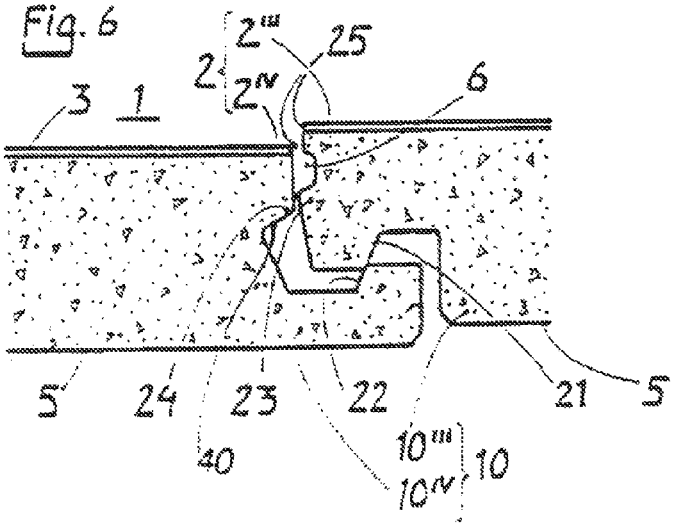
FIG. 6 shows, in cross-section, a second embodiment of a third and a fourth edge $\mathbf{2}^{III}$ and $\mathbf{2}^{IV}$ respectively, during joining.
Figure 7:
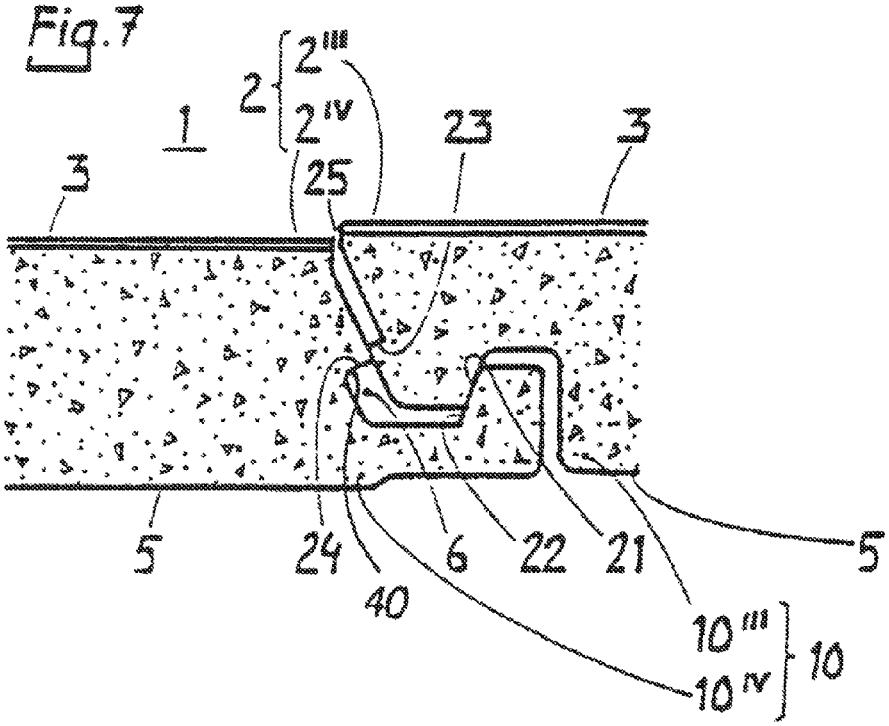
FIG. 7 shows, in cross-section, a third embodiment of a third and a fourth edge $\mathbf{2}^{III}$ and $\mathbf{2}^{IV}$ respectively, during joining.

Shown at 40, in both FIGS. 6 and 7, are mainly horizontal locking surfaces of undercut 24. Specifically, mainly horizontal locking surfaces 40 are designed to interact with snapping hook 23 to lock the respective floor elements 1 in place.

The joint between a third and a fourth edge $\mathbf{2}^{III}$ and $\mathbf{2}^{IV}$ respectively of two joined floor elements 1 further comprises contact surfaces which are constituted by the horizontal locking surfaces of the under cuts 24 and hooks 23, the mainly vertical upper cheek surfaces 22 lower cheek surfaces as well as upper mating surfaces 25. The joint between two joined floor elements 1 also comprise cavities 6.

The embodiment shown in FIG. 7 corresponds in the main with the one shown in FIG. 6. The snapping hook 23 on the male vertical assembly joining member $\mathbf{10}^{III}$ is, however, moved somewhat inwards in the floor element 1 whereby a guiding angle is formed above the undercut 24 of the female vertical joining member $\mathbf{10}^{IV}$.

Figure 8:
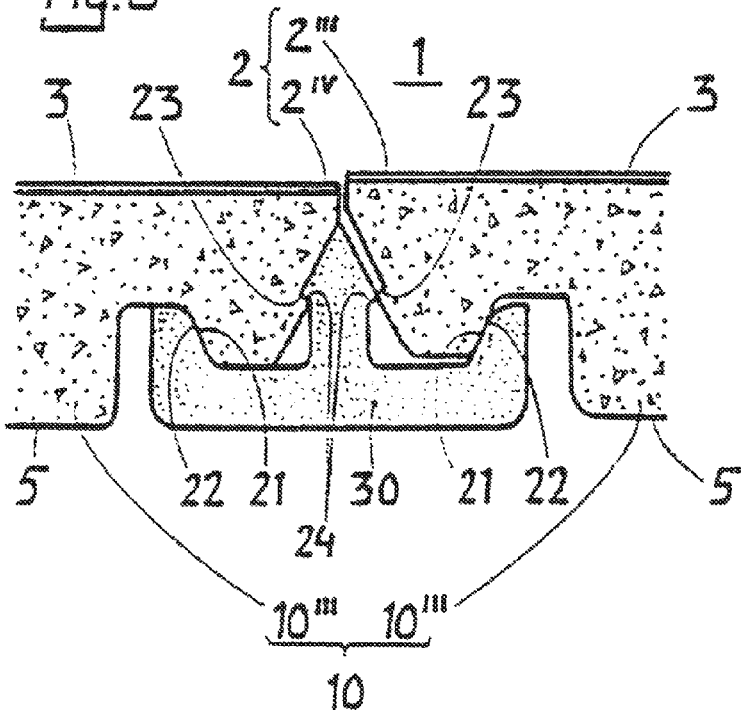
FIG. 8 shows, in cross-section, a fourth embodiment of a third and a fourth edge $\mathbf{2}^{III}$ and $\mathbf{2}^{IV}$ respectively and a vertical assembly joining profile 30, during joining.

The embodiment shown in FIG. 8 corresponds mainly with the one shown in FIG. 7. Both the third and the fourth edges $\mathbf{2}^{III}$ and $\mathbf{2}^{IV}$ respectively are, however, provided with male vertical assembly joining members $\mathbf{10}^{III}$. A vertical assembly joining profile 30, provided with a female vertical assembly joining profile $\mathbf{10}^{IV}$ on both sides of a vertical symmetry line, is used for joining the two floor elements 1. The female vertical assembly joining members $\mathbf{10}^{IV}$ of the vertical assembly joining profile 30 are equipped similar to the female vertical assembly joining members $\mathbf{10}^{IV}$ in FIG. 7 above.

Two adjacent edges 2 of a floor element 1 can at the same time, and in the same turning motion, be joined with a floor element 1 adjacent to the first edge $\mathbf{2}^{I}$ and a floor element 1 adjacent to the third or fourth edge $\mathbf{2}^{III}$ and $\mathbf{2}^{IV}$ respectively, when assembling floor elements 1 according to the above described embodiments.

The floor elements 1 according to the present invention most often comprises a core. The core is most often comprised of particles or fibre of wood bonded with resin or glue. It is advantageous to coat the surface closest to the joint in cases where the floor will be exposed to high levels of moisture since the cellulose based material is sensitive to moisture. This coating may suitably incorporate resin, wax or some kind of lacquer. It is not necessary to coat the joint when it is to be glued since the glue itself will protect from moisture penetration. The upper decorative layer 3 is constituted of a decorative paper impregnated with melamine-formaldehyde resin. One or more so called overlay sheets of α-cellulose, impregnated with melamine-formaldehyde resin may possibly be placed on top of the decorative layer. The abrasion resistance may be improved by sprinkling one or more of the sheets with hard particles of for example α-aluminum oxide, silicon carbide or silicon oxide. The lower side 5 may suitably be coated with lacquer or a layer of paper and resin.

The invention is not limited by the embodiments shown since they can be varied within the scope if the invention.

According to a first particularly preferred embodiment, the invention relates to flooring material comprising sheet-shaped floor elements with a mainly square or rectangular shape, which floor elements are provided with edges, a lower side and an upper decorative layer, whereby the floor elements are joined by means of joining members, the edges being separated into a first and a second edge, which first and second edges are arranged on opposite sides, and a third and a fourth edge being adjacent to the first and the second edge and which third and fourth edges are arranged on sides opposite to one another, whereby the floor elements are provided with male joining members on the first edge, having a tongue and a lower side groove, and female joining members on the second edge, having a groove and a cheek, the cheek being provided with a lip, whereby the floor elements are joined together via the male and female joining members by tilting the floor element to be joined with an already installed floor element or a row of already installed floor elements, with the male joining member of the floor element angled downwards, that the first edge is positioned mainly parallel to the second edge of the already installed floor element or row of floor elements, whereupon the tongue of the titled floor element is inserted into the groove of the female joining member of the already installed floor element or row of floor elements, whereby the tilted floor element is turned downwards, with its lower edge as a pivot axis, so that the lip eventually snaps into the lower side groove where the decorative upper layer of the floor elements are mainly parallel, and that the third and fourth edges of the floor elements are joined by means of joining members selected from the group consisting of: a) wherein the floor elements, on the third edge, are provided with a male vertical assembly joining member while the fourth edge is provided with a female vertical assembly joining member, the fourth edge being arranged on a side opposite to the third edge, the male vertical assembly joining members being provided with mainly vertical lower cheek surfaces arranged parallel to the third edge, which lower cheek surfaces are arranged to interact with undercuts arranged on the female vertical assembly joining members so that two joined adjacent floor elements becomes locked to each other in a horizontal direction, that together the male and female vertical assembly joining members are provided with at least one snapping hook to interact with said undercuts which by being provided with a mainly horizontal locking surface limits the vertical movement between two joined adjacent floor elements, whereby the third edge and the fourth edge are joined with respective edges of adjacent floor elements through vertical motion, and b) wherein the floor elements on the third edge, are provided with a male vertical assembly joining member while the fourth edge also is provided with a male vertical assembly joining member, the fourth edge being arranged on a side opposite to the third edge, which adjacent male vertical assembly joining members are joined by means of a separate vertical assembly joining profile which vertical assembly profile is provided with female vertical assembly joining member, the male vertical assembly joining members being provided with mainly vertical lower cheek surfaces arranged parallel to either the third or the fourth the edge, which lower cheek surfaces are arranged to interact with mainly vertical upper cheek surfaces arranged on the female vertical assembly joining members so that two joined adjacent floor elements becomes locked to each other in a horizontal direction, that together the male and female vertical assembly joining members are provided with at least one snapping hook to interact with said undercut which by being provided with a mainly horizontal locking surface limits the vertical movement between two joined adjacent floor elements, whereby the third edge and the fourth edge are joined with respective edges of adjacent floor elements through vertical motion, whereby two adjacent edges of a floor element at the same time, and concurrently with the turning motion, is joined with a floor element adjacent to the first edge and a floor element adjacent to the third or fourth edge.

In such particularly preferred embodiment, the force needed to overcome the static friction along the joint between two completely assembled male and female joining members is preferably larger than 10N per meter of joint length.

In such particularly preferred embodiment, the floor elements are preferably provided with male vertical assembly joining members on a third edge and provided with female vertical assembly joining members on a fourth edge, the male vertical assembly joining members being provided with mainly vertical lower cheek surfaces arranged parallel to the third edge, which lower cheek surfaces are arranged to interact with mainly vertical upper cheek surfaces arranged on the female vertical assembly joining members so that two joined adjacent floor elements becomes locked to each other in a horizontal direction, that together the male and female vertical assembly joining members are provided with at least one snapping hook with matching undercut which by being provided with a mainly horizontal locking surface limits the vertical movement between two joined adjacent floor elements.

Preferably, the joint between third and the fourth edge of two joined floor elements comprises contact surfaces which are constituted by the mainly horizontal locking surfaces of the undercuts and hooks, the mainly vertical upper cheek surfaces and lower cheek surfaces as well as upper mating surfaces.

Preferably, the joint between two joined floor elements also comprises cavities.

The said snapping hook can be constituted by a separate spring part placed in a cavity.

Preferably such spring part is constituted by an extruded thermoplastic profile.

Preferably, such spring part is constituted by a profile of a thermosetting resin.

Alternatively, such spring part is constituted by an extruded metal profile.

In such particularly preferred embodiment, the undercut may be constituted by a separate spring part which is placed in a cavity.

Preferably, such spring part is constituted by an extruded thermoplastic profile.

Alternatively, such spring part is constituted by a profile of a thermosetting resin.

Further alternatively, such spring part may be constituted by an extruded metal profile.

In such particularly preferred embodiment, the floor elements may be coated with twin-faced adhesive tape or glue.

In such particularly preferred embodiment, the joining members may be coated with twin-faced adhesive tape or glue.

In such particularly preferred embodiment, the force needed to overcome the static friction along the joint between two completely assembled male and female joining members is preferably larger than 100N per meter of joint length.

According to a second particularly preferred embodiment, the invention relates to a surface element designed to be assembled together with similar surface elements to form a unit of a plurality of joined surface elements; said surface elements comprising a core, a decorative upper surface and edges for joining, at least one of said edges for joining comprising a cavity, and a separate spring part placed in said cavity.

In such particularly preferred embodiment, the spring part is preferably formed of thermoplastic.

Alternatively, such spring part is formed of thermosetting resin or of metal.

Such spring part may comprise a snapping hook or an undercut.

In such second particularly preferred embodiment, the decorative surface preferably comprises a laminate or a lacquer.

The invention further relates to an assembled unit of a plurality of surface elements described herein above. Clearly, such assembled unit of surface elements preferably is characterized in that the edges for joining comprise a male joining element and female joining element on an opposite side edge, and third and fourth joining edges, the male and female joining elements capable of being joined by tilting the surface elements and relatively inserting the tongue into the groove and relatively turning downwards the surface elements towards one another and at least one of the third and fourth edges comprising the spring part.

What is claimed is:

1. A surface element designed to be assembled together with similar surface elements to form a plurality of joined surface elements:

the surface element comprising a core, a decorative upper surface, an opposed lower surface and at least four edges disposed between the upper and lower surfaces;

the four edges comprising a first edge and a second edge defining a first pair of opposite sides, and a third edge and a fourth edge defining a second pair of opposite sides;

wherein the first edge of the surface element comprises a first male joining member and a second edge comprises a first female joining member;

the first male joining member comprising a tongue and the first female joining member comprising a groove;

the first male joining member and the first female joining member being configured such that two surface elements can be coupled and vertically as well as horizontally locked at respective edges by rotational movement, the third edge as a result of the rotational movement being subjected to a lowering motion;

wherein the third edge of the surface element comprises a second male joining member and the fourth edge comprises a second female joining member, said second female joining member configured as a seat which is open in an upward direction, said second male joining member configured as a downward directed part that by a downward motion can be inserted in said seat of an adjacent said second female joining member;

wherein the third and fourth edges are configured such that the downward directed part at the third edge is inserted in the seat of the fourth edge of the adjacent second female joining member simultaneously with said lowering motion of the respective third edge, resulting in vertical as well as horizontal locking;

the second male joining member comprising a locking surface limiting the vertical movement between said third edge and said fourth edge of the adjacent second female joining member when connected thereto;

said locking surface having a distal end which is proximally located from the distal end of the upper surface of said surface element at said third edge.

2. The surface element of claim 1, wherein said second female joining member comprises an undercut cooperating with said locking surface of said second male joining member.

3. The surface element of claim 1, wherein said second male joining member is formed as an upper cheek protruding at said third edge and said second female joining member is formed as a lower cheek protruding at said fourth edge; said second male joining member comprising cheek surfaces at a lower side of said upper cheek and said second female joining member comprising cheek surfaces at an upper side of said lower cheek; the cheek surfaces of said second male and said second female joining member arranged to interact with one another so that two joined adjacent floor elements become locked to each other in a horizontal direction.

4. A surface element designed to be assembled together with similar surface elements to form a plurality of joined surface elements:

the surface element comprising a core, a decorative upper surface, an opposed lower surface and at least four edges disposed between the upper and lower surfaces;

the four edges comprising a first edge and a second edge defining a first pair of opposite sides, and a third edge and a fourth edge defining a second pair of opposite sides;

wherein the first edge of the surface element comprises a first male joining member and a second edge comprises a first female joining member;

the first male joining member comprising a tongue and the first female joining member comprising a groove;

the first male joining member and the first female joining member being configured such that two surface elements can be coupled and vertically as well as horizontally locked at respective edges by rotational movement, the third edge as a result of the rotational movement being subjected to a lowering motion;

wherein the third edge of the surface element comprises a second male joining member and the fourth edge comprises a second female joining member, said second female joining member configured as a seat which is open in an upward direction, said second male joining member configured as a downward directed part that by a downward motion can be inserted in said seat of an adjacent said second female joining member;

wherein the third and fourth edges are configured such that the downward directed part at the third edge is inserted in the seat of the fourth edge of the adjacent second female joining member simultaneously with said lowering motion of the respective third edge, resulting in vertical as well as horizontal locking;

the second male joining member comprising a locking surface limiting the vertical movement between said third edge and said fourth edge of the adjacent second female joining member when connected thereto;

said locking surface being positioned completely vertically below the upper surface of said surface element at said third edge.

5. The surface element of claim 4, wherein said second female joining member comprises an undercut cooperating with said locking surface of said second male joining member.

6. The surface element of claim 4, wherein said second male joining member is formed as an upper cheek protruding at said third edge and said second female joining member is formed as a lower cheek protruding at said fourth edge; said second male joining member comprising cheek surfaces at a lower side of said upper cheek and said second female joining member comprising cheek surfaces at an upper side of said lower cheek; the cheek surfaces of said second male and said second female joining member arranged to interact with one another so that two joined adjacent floor elements become locked to each other in a horizontal direction.

7. A surface element designed to be assembled together with similar surface elements to form a plurality of joined surface elements:

the surface element comprising a core, a decorative upper surface, an opposed lower surface and at least four edges disposed between the upper and lower surfaces;

the four edges comprising a first edge and a second edge defining a first pair of opposite sides, and a third edge and a fourth edge defining a second pair of opposite sides;

wherein the first edge of the surface element comprises a first male joining member and a second edge comprises a first female joining member;

the first male joining member comprising a tongue and the first female joining member comprising a groove;

the first male joining member and the first female joining member being configured such that two surface elements can be coupled and vertically as well as horizontally locked at respective edges by rotational movement, the third edge as a result of the rotational movement being subjected to a lowering motion;

wherein the third edge of the surface element comprises a second male joining member and the fourth edge comprises a second female joining member, said second female joining member configured as a seat which is open in an upward direction, said second male joining member configured as a downward directed part that by a downward motion can be inserted in said seat of an adjacent said second female joining member;

wherein the third and fourth edges are configured such that the downward directed part at the third edge is inserted in the seat of the fourth edge of the adjacent second female joining member simultaneously with said lowering motion of the respective third edge, resulting in vertical as well as horizontal locking;

the second male joining member comprising a locking surface limiting the vertical movement between said third edge and said fourth edge of the adjacent second female joining member when connected thereto;

the second male joining member being free from portions protruding beyond the upper surface of said surface element at said third edge.

8. The surface element of claim 7, wherein said second female joining member comprises an undercut cooperating with said locking surface of said second male joining member.

9. The surface element of claim 7, wherein said second male joining member is formed as an upper cheek protruding at said third edge and said second female joining member is formed as a lower cheek protruding at said fourth edge; said second male joining member comprising cheek surfaces at a lower side of said upper cheek and said second female joining member comprising cheek surfaces at an upper side of said lower cheek; the cheek surfaces of said second male and said second female joining member arranged to interact with one another so that two joined adjacent floor elements become locked to each other in a horizontal direction.

* * * * *